US006001551A

United States Patent [19]

Shimada et al.

[11] Patent Number: 6,001,551

[45] Date of Patent: Dec. 14, 1999

[54] SILVER HALIDE COLOR LIGHT-SENSITIVE MATERIAL

[75] Inventors: Yasuhiro Shimada; Koushin Matsuoka; Hiroyuki Yoneyama, all of Kanagawa, Japan

[73] Assignee: Fuji Photo Film Co., Ltd., Kanagawa, Japan

[21] Appl. No.: 08/342,025

[22] Filed: Nov. 16, 1994

[30] Foreign Application Priority Data

Nov. 16, 1993 [JP] Japan ..... 5-286911

[51] Int. Cl.[6] ..... G03C 1/08; G03C 7/26; G03C 7/32

[52] U.S. Cl. ..... 430/558; 430/384; 430/385

[58] Field of Search ..... 430/503, 558, 430/384, 385

[56] References Cited

U.S. PATENT DOCUMENTS

| | | | |
|---|---|---|---|
| 5,270,153 | 12/1993 | Suzuki et al. | 430/384 |
| 5,348,847 | 9/1994 | Suzuki et al. | 430/558 |
| 5,366,856 | 11/1994 | Shimada et al. | 430/558 |
| 5,384,236 | 1/1995 | Matsuoka et al. | 430/558 |

FOREIGN PATENT DOCUMENTS

| | | |
|---|---|---|
| 0566115 | 10/1993 | European Pat. Off. . |
| 5333497 | 12/1993 | Japan . |
| 5333500 | 12/1993 | Japan . |
| 5341467 | 12/1993 | Japan . |
| 63784 | 1/1994 | Japan . |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color light-sensitive material containing a cyan coupler which provides an excellent hue and an improved fastness at a low color-developing area and which has small change in a color developing density, which is caused by change of a composition of a blix solution and provides a small fog in a cyan color at a non-exposed area in a continuous processing. The silver halide color light-sensitive material contains at least one cyan coupler represented by the following Formula (I) in at least one layer on a support:

(I)

wherein Y represents —N═ or —C($R_3$)═; X represents a hydrogen atom or a group which splits off upon a coupling reaction with an oxidized product of a color developing agent; Z represents a non-metallic atomic group necessary for forming an alicyclic group or a heterocyclic ring; $R_1$, $R_2$ and $R_3$ each represents a hydrogen atom or a substituent; and $R_1$ contributes to form an unsaturated bond in a ring formed by Z or combined with the atoms on the ring formed by Z to form a ring.

16 Claims, No Drawings

SILVER HALIDE COLOR LIGHT-SENSITIVE MATERIAL

FIELD OF THE INVENTION

The present invention relates to a silver halide color light-sensitive material (hereinafter referred to simply as a light-sensitive material).

BACKGROUND OF THE INVENTION

It is well known that in a silver halide color light-sensitive material, an aromatic primary amine color developing agent oxidized with exposed silver halide used as an oxidizing agent is reacted with a coupler to form an indophenol, indoaniline, indamine, azomethine, phenoxazine, and phenazine dyes, and the dyes related thereto, whereby a dye image is formed. In such a photographic system, a subtractive color process is used, and generally the dye image is formed with yellow, magenta and cyan dyes.

A phenol or naphthol coupler is generally used for forming a cyan dye image. However, these couplers have a large problem that since they have an unfavorable absorption in a green light region, they markedly deteriorate a color reproducibility, and therefore the solution therefor is desired.

The heterocyclic compounds described in U.S. Pat. Nos. 4,728,598 and 4,873,183, and European Patent 0249453A2 are proposed as the means for solving this problem. However, these couplers have a fatal problem that they have the low coupling activities. There are proposed as the couplers which overcome these problems, pyrazoloazoles described in European Patent Publications 0488248A1 and 0484909A1, and JP-A-5-232649 (the term "JP-A" as used herein means an unexamined published Japanese patent application). These couplers are excellent in terms a coupling activity and a hue. However, the dyes formed from pyrazoloazoles shown in these patents have the problem that a color developing density changes due to change of a composition of a bleach-fixing solution (hereinafter referred to as a blix solution). It is the phenomenon which notably appeared particularly when the concentrations of a thiosulfuric acid ion or a sulfurous acid ion contained in the blix solution is changed by a continuous processing. Further, also in terms of a fastness of a dye image after processing, the fastness at a relatively low color-developing density area is inferior to that at a high color developing density area, and the improvement thereof has been desired. Furthermore, there has been involved the problem that cyan color fog at a non-developed area is large, and the improvement thereof has been desired.

SUMMARY OF THE INVENTION

The first object of the present invention is to provide a silver halide color light-sensitive material containing a cyan coupler which has a high coupling activity and provides excellent hue, and which provides only small color developing density variation due to change of a composition of a blix solution.

The second object of the present invention is to provide a silver halide color light-sensitive material containing a cyan coupler capable of providing an color image having improved fastness at a low color-developing area.

The third object of the present invention is to provide a silver halide color light-sensitive material containing a cyan coupler capable of providing only small cyan color fog at a non-exposed area in a continuous processing.

The objects of the present invention have been achieved by a silver halide color light-sensitive material containing at least one of the cyan couplers represented by the following Formula (I) in at least one layer on a support:

(I)

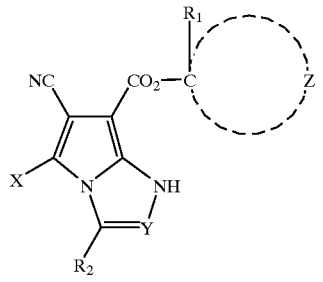

wherein Y represents —N═ or —C($R_3$)═; X represents a hydrogen atom or a group which splits off upon a coupling reaction with an oxidized product of a color developing agent; Z represents a non-metallic atomic group necessary for forming an alicyclic group (an aromatic ring in no case) or a heterocyclic ring; $R_1$, $R_2$ and $R_3$ each represents a hydrogen atom or a substituent; and $R_1$ contributes to form an unsaturated bond in a ring formed by Z or $R_1$ is combined with the atoms on the ring formed by of to form a ring.

DETAILED DESCRIPTION OF THE INVENTION

In the present invention, an aliphatic moiety may be a linear, branched, cyclic (e.g., cycloalkyl), saturated or unsaturated (e.g., alkenyl), and substituted or unsubstituted groups unless otherwise described. Among them an alkyl group is preferred.

In the present invention, an aromatic moiety may be a substituted or unsubstituted, monocyclic ring (e.g., phenyl) or a condensed ring (e.g., naphthyl). A phenyl group is preferred as the aryl moiety.

In the present invention, when the substituent represented by $R_1$, $R_2$ or $R_3$ includes a heterocyclic ring, the ring include at least one of a nitrogen atom, an oxygen atom and a sulfur atom as a hetero atom. The number of the members of the ring is preferably 5 to 8, and a carbon atom and a nitrogen atom on the ring may be substituted or unsubstituted. The ring may be a monocyclic ring or a condensed ring (for example, with a benzene ring).

The number of the carbon atom of the substituent in the instant specification means the number of the total carbon atoms in the whole substituent.

Formula (I) is explained in more detail below.

Y represents —N═ or —C($R_3$)═. In the present invention, Y is preferably —N═.

$R_1$, $R_2$ and $R_3$ each represents a hydrogen atom or a substituent. The substituent includes, for example, a halogen atom (e.g., a chlorine atom and a bromine atom), an aliphatic group (preferably having 1 to 36 carbon atoms, such as a linear or branched alkyl group, an aralkyl group, an alkenyl group, and an alkynyl group, a cycloalkyl group, and a cycloalkenyl group (e.g., methyl, ethyl, propyl, isopropyl, t-butyl, tridecyl, 2-methanesulfonylethyl, 3-(3-pentadecylphenoxy)propyl, 3-[4-{2-[4-(4-hydroxyphenylsulfonyl)phenoxy]dodecanamido}phenyl]propyl, 2-ethoxytridecyl, trifluoromethyl, cyclopentyl, and 3-(2,4-di-t-amylphenoxy)propyl), an aryl group preferably having 6 to 36 carbon atoms (e.g., phenyl, naphthyl, 4-hexadecyloxyphenyl, 4-t-butylphenyl, 2,4-di-t-amylphenyl, 4-tetradecanamidophenyl, and 3-(2,4-di-tertamylphenoxyacetoamido)phenyl), a heterocyclic group (e.g., 3-pyridyl, 2-furyl, 2-thienyl, 2-pyridyl, 2-pyrimidinyl, and 2-benzothiazolyl), an alkoxy group preferably having 1 to 30 carbon atoms (e.g., methoxy, ethoxy, 2-methoxyethoxy, 2-dodecyloxyethoxy, and 2-methanesulfonylethoxy), an aryloxy group preferably having 6 to 30 carbon atoms (eg., phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, and 3-methoxycarbamoylpenoxy), a heterocyclic ring oxy group (for example, 2-benzimidazolyloxy, 1-phenyltetrazole-5-oxy, and 2-tetrahydropyranyloxy), an alkyl-, aryl- or heterocyclic ring thio group preferably having 1 to 36 carbon atoms (e.g., methylthio, ethylthio, octylthio, tetradecylthio, 2-phenoxyethylthio, 3-phenoxypropylthio, 3-(4-tert-butylphenoxy)propylthio, phenylthio, 2-butoxy-5-tert-octyolphenylthio, 3-pentadecylphenylthio, 2-carboxyphenylthio, 4-tetradecaneamidophenylthio, 2-benzothiazolylthio, 2,4-di-phenoxy-1,3,4-triazole-6-thio, and 2-pyridylthio), an acyloxy group, such as an aliphatic- (e.g., alkyl), aromatic- (e.g., aryl), and heterocyclic acyloxy group preferably having 2 to 30 carbon atoms (e.g., acetoxy and hexadecanoyloxy), a carbamoyloxy group preferably having 1 to 30 carbon atoms (e.g, N-ethyl-carbamoyloxy and N-phenylcarbamoyloxy), a silyloxy group preferably having 3 to 30 carbon atoms (e.g., trimethylsilyloxy and dibutylmethylsilyloxy), an alkyl-, aryl- or heterocyclic ring sulfonyloxy group preferably having 1 to 30 carbon atoms (e.g., dodecylsulfonyloxy), an acylamino group such as an aliphatic-, aromatic- and heterocyclic-acylamino group preferably having 2 to 30 carbon atoms (e.g., acetamido, benzamido, tetradecaneamido, 2-(2,4-di-tert-amylphenoxy) acetamido, 2-[4-(4-hydroxyphenylsulfonyl)phenoxy] decaneamido, isopentadecaneamido, 2-(2,4-di-t-amyl-phenoxy)butaneamido, and 4-(3-t-butyl-4-hydroxyphenoxy) butaneamido), an alkylamino group preferably having 1 to 30 carbon atoms (e.g, methylamino, butylamino, dodecylamino, dimethylamino, diethylamino, and methylbutylamino), an arylamino group preferably having 6 to 30 carbon atoms (e.g., phenylamino, 2-chloroanilino, 2-chloro-5-tetradecaneamidoanilino, N-acetylanilino, 2-chloro-5-[(α-2-tert-butyl-4-hydroxyphenoxy) docaneamido]anilino, and 2-chloro-5-dodecyloxycarbonylanilino), a ureido group preferably having 2 to 30 carbon atoms (e.g., methylureido, phenylureido, N,N-dibutylureido, and dimethylureido), a sulfamoylamino group preferably having 1 to 30 carbon atoms (e.g., N,N-dipropylsulfamoylamino and N-methyl-N-decylsulfamoylamino), an alkenyloxy group preferably having 2 to 30 carbon atoms (e.g., propenyloxy), a formyl group, an acyl group such as an aliphatic- (e.g., alkyl), aromatic- (e.g., aryl) and heterocyclic-acyl group preferably having 2 to 30 carbon atoms (e.g., acetyl, benzoyl, 2,4-di-tert-amylphenylacetyl, 3-phenylpropanoyl, and 4-dodecyl-oxybenzoyl), an alkyl-, aryl- or heterocyclic ring-sulfonyl group preferably having 1 to 30 carbon atoms (e.g., methanesulfonyl, octanesulfonyl, benzenesulfonyl, and tluenesulfonyl), an alkyl-, aryl- or heterocyclic ring-sulfinyl group preferably having 1 to 30 carbon atoms (e.g., octanesulfinyl, dodecylsulfinyl, phenylsulfinyl, 3-pentadecylphenylsulfinyl, and 3-phenoxypropylsulfinyl), an alkyl-, aryl- or heterocyclic ring-oxycarbonyl group preferably having 2 to 30 carbon atoms (e.g., methoxycarbonyl, butoxycarbonyl, dodecyloxycarbonyl, octadecyloxycarbonyl, phenyloxycarbonyl, and 2-pentadecyloxycarbonyl), an alkyl-, aryl- or heterocyclic ring-oxycarbonylamino group preferably having 2 to 30 carbon atoms (e.g., methoxycarbonylamino, tetradecyloxycarbonylamino, phenoxycarbonylamino, and 2,4-di-tert-butylphenoxycarbonylamino), an alkyl-, aryl- or heterocyclic ring-sulfonamido group preferably having 1 to 30 carbon atoms (e.g., methanesulfonamido, hexadecanesulfonamido, benzenesulfonamido, p-toluenesulfonamido, octadecanesulfonamido, and 2-methoxy-5-tert-butylbenzenesulfonamido), a carbamoyl group preferably having 1 to 30 carbon atoms (e.g., N-ethylcarbamoyl, N,N-dibutylcarbamoyl, N-(2-dodecyloxyethyl)carbamoyl, N-methyl-N-dodecylcarbamoyl, and N-[3-(2,4-di-tert-amylphenoxy) propyl]carbamoyl), a sulfamoyl group preferably having 1 to 30 carbon atoms (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a phosphonyl group preferably having 1 to 30 carbon atoms (e.g., phenoxyphosphonyl ($C_6H_5OPH(O)$—), octyloxyphosphonyl, and phenylphosphonyl), a phosphoryl group preferably having 1 to 30 carbon atoms (e.g., diphenyloxyphosphoryl ($(C_6H_5O)_2P(O)$—), and dioctyloxyphosphoryl), an imido group preferably having 1 to 30 carbon atoms (e.g., N-succinimido, hydantoinyl, N-phthalimido, and 3-octadecenylsuccinimido), an azolyl group (e.g., imidazolyl, pyrazolyl, 3-chloropyrazole-1-yl, and triazolyl), a hydroxy group, a cyano group, —COOM and —$SO_3M$ (wherein M represents a hydrogen atom, an alkali metal atom such as Li, Na and K, or $NH_4$) a nitro group, and an unsubstituted amino group. As shown in the parentheses, these substituents may be further substituted with at least one of substituents recited hereinabove.

$R_1$ may form an unsaturated bond in the ring formed by Z to form the following structure:

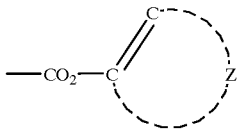

provided that in the case where the ring formed by Z is an alicyclic, it may do that within a range in which an aromatic ring is not formed. Further, $R_1$ may be combined with the atoms (for example, a carbon atom, a nitrogen atom and a phosphorous atom) on the ring formed by Z to form a ring, and accordingly a bicycle or a tricycle may be formed with the ring formed by $R_1$ and Z.

$R_1$ is preferably a hydrogen atom, a halogen atom, an alkyl group having 1 to 30 carbon atoms, an alkoxy group having 1 to 30 carbon atoms, an aryl group having 6 to 30 carbon atoms, an aryloxy group having 6 to 30 carbon atoms, an alkyl-, aryl- or heterocyclic ring-oxycarbonyl group, or an alkyl-, aryl- or heterocyclic ring-oxycarbonylamino group. $R_1$ is more preferably a hydrogen atom, an alkyl group having 1 to 30 carbon atoms, an alkoxy group having 1 to 30 carbon atoms, an aryl group having 6 to 30 carbon atoms, or an aryloxy group having 6 to 30 carbon atoms, and particularly preferably a hydrogen atom.

Preferred $R_2$ and $R_3$ each is an alkyl group, an aryl group, a heterocyclic ring group, a carbamoyl group, an acylamino group, or a ureido group, and an alkyl group or an aryl group is more preferred. Specifically preferred is a branched alkyl group or an aryl group substituted with at least one of an alkoxy group, a halogen atom, a sulfonamido group, and an acylamino group.

In Formula (I), X represents a hydrogen atom or a group (hereinafter referred to simply as a splitting group) which is split off when the coupler reacts with an oxidized product of a color developing agent. When X represents the splitting group (or atom), the splitting group includes a halogen atom, an alkoxy group, an aryloxy group, a heterocyclic ring oxy group, aliphatic- (e.g., alkyl), aromatic- (e.g., aryl), or heterocyclic-acyloxy group, an alkyl-, aryl- or heterocyclic-sulfonyloxy group, a dialkyl- or diaryl-phosphonoxy group, a dialkyl- or diaryl-phosphinoxy group, an alkoxycarbonyloxy group, an aryloxycarbonyloxy group, a heterocyclic ring oxycarbonyloxy group, an alkyl-, aryl- or heterocyclic ring-sulfonyl group, an alkyl-, aryl- or heterocyclic ring-sulfinyl group, an alkyl-, aryl- or heterocyclic ring-carbonyl group, an acylamino group such as an aliphatic- (e.g., alkyl), aromatic- (e.g., aryl) or heterocyclic-acylamino group, an alkyl-, aryl- or heterocyclic ring-sulfonamido group, a carbamoylamino group, an alkyl-, aryl- or heterocyclic ring-thio group, an imido group, an arylazo group, and a 5-membered or 6-membered nitrogen-containing heterocyclic ring group which is bonded to a coupling moiety via a nitrogen atom. An alkyl moiety, an aryl moiety or a heterocyclic moiety contained in these splitting groups may be substituted with at least one of the substitutents enumerated for $R_3$. When these substituents are two or more, they may be the same or different, and these substituents may further have the substituents enumerated for $R_3$.

To be more detailed, the splitting group includes a halogen atom (for example, a fluorine atom, a chlorine atom and a bromine atom), an alkoxy group (for example, ethoxy, dodecyloxy, methoxyethylcarbamoylmethoxy, carboxypropyloxy, methylsulfonylethoxy, and ethoxycarbonylmethoxy), an aryloxy group (for example, 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), a heterocyclic ring oxy group (for example, 5-phenyltetrazolyloxy and 2-benzothiazolyloxy), an aliphatic- (e.g., alkyl), aromatic- (e.g., aryl) or heterocyclic-acyloxy group (for example, acetoxy, tetradecanoyloxy, and benzolyoxy), an alkyl-, aryl- or heterocyclic ring-sulfonyloxy group (for example, methanesulfonyloxy and toluenesulfonyloxy), a dialkyl- or diaryl-phosphonoxy group (for example, diethylphosphonoxy and diphenylphosphonoxy), a dialkyl- or diarylphosphinoxy group (for example, dimethylphosphinoxy), an alkyl-, aryl- or heterocyclic ring-sulfonyl group (for example, toluenesulfonyl, methanesulfonyl, and tetrazolylsulfonyl), an alkyl-, aryl- or heterocyclic ring-sulfinyl group (for example, phenylsulfinyl, i-propylsulfinyl, and tetrazolylsulfinyl), an aliphatic- (e.g., alkyl), aromatic- (e.g., aryl) or heterocyclic-acylamino group (for example, dicholoracetylamino and heptafluorobutylylamino), an alkyl-, aryl- or heterocyclic ring-sulfonamido group (for example, methanesulfonamido, trifluoromethanesulfonamido, and p-tolunesulfonamido), an alkoxycarbonyloxy group (for example, ethoxycarbonyloxy and benzyloxycarbonyloxy), an aryloxycarbonyloxy group (for example, phenoxycarbonyloxy), an alkyl-, aryl- or heterocyclic ring-thio group (for example, ethylthio, 2-carboxyethylthio, dodecylthio, 1-carboxydodecylthio, phenylthio, perfluorophenylthio, 2-butoxy-5-t-octylphenylthio, and tetrazolylthio), a carbamoylamino group (for example, N-methylcarbamoylamino and N-phenylcarbamoylamino), a 5-membered or 6-membered nitrogen-containing heterocyclic ring group bonded to a coupling site via a nitrogen atom (for example, imidazolyl, pyrazolyl, triazolyl, tetrazolyl, and, 1,2-dihydro-2-oxo-1-pyridyl), an imido group (for example, succinimido and hydantoinyl), and an arylazo group (for example, phenylazo and 4-methoxyphenylazo). There is a bis type coupler having a splitting group bonded to the coupler moiety via a carbon atom such a coupler may be obtained by condensing a tetraequivalent coupler with aldehydes or ketones. The splitting group according to the present invention may contain the photographically useful groups such as a development inhibitor and a development accelerator.

X is preferably a hydrogen atom, a halogen atom, an alkoxy group, an aryloxy group, an alkyl- or aryl-thio group, or a 5-membered or 6-membered nitrogen-containing heterocyclic group bonded to a coupling active site via a nitrogen atom. X is more preferably a hydrogen atom or a halogen atom. It is particularly preferably a chlorine atom.

In Formula (I), Z represents a non-metallic atomic group necessary for forming an alicyclic ring (an aromatic ring in no case) or a heterocyclic ring. Each ring is a 3- to 12-membered ring, preferably a 5- to 8-membered ring, and it may further be condensed. At least one atom (for example, a carbon atom, a nitrogen atom and a phosphorous atom) in the ring may have at least one substituent. Herein, the substituents include those enumerated for $R_3$ described above.

The alicyclic group formed by Z means a hydrocarbon ring and what is not an aromatic (aryl) ring. Accordingly, it may be an unsaturated ring, having no aromaticity as well as a saturated ring. The alicyclic group formed by Z is formed by an alkylene group, an alkenylene group or a combination thereof. It is formed preferably by the alkylene group.

The heterocyclic ring formed by Z is a ring having thereon at least one of a hetero atom, for example, a nitrogen atom, a sulfur atom, an oxygen atom and a phosphorous atom, and it may be either a saturated ring or an unsaturated ring and a substituted ring or an unsubstituted ring.

The heterocyclic ring formed by Z is formed preferably by an alkylene group, an alkenylene group, a divalent amino group (—NH—), an ether bond (—O—), a thioether bond (—S—), an imino group (—N=), a sulfonyl group, a carbonyl group, and the combination of the plurality thereof, and it is formed more preferably by the alkylene group or the alkenylene group, and the divalent amino group, the ether bond, the thioether bond or the imino group.

The alicyclic group of the present invention formed by Z (including the case in which an unsaturated bond or a ring is formed by $R_1$) includes a cyclopropane ring, a cyclobutane ring, a cyclobutene ring, a cyclopentane ring, a cyclopentene ring, a cyclohexane ring, a cyclohexene ring, a cyclohexadiene ring, a cycloheptane ring, a cyclooctane ring, a norbornane ring, and an adamantane ring.

Example of the heterocycle according to the present invention formed by Z (including the case in which an unsaturated bond or a ring is formed by $R_1$) include an oxirane ring, an oxolane ring, a 1,3-dioxolane ring, a furan ring, a 1,3-dioxane ring, a 1,4-dioxane ring, a γ-pyran ring, an oxane ring, a thiophene ring, a thiolane ring, a thiane ring, a 1,4-dithiane ring, an azetidine ring, a pyrrole ring, a pyrrolidine ring, a pyrazole ring, a 2-pyrazoline ring, a pyrazolidine ring, an imidazole ring, a 2-imidazoline ring, an imidazolidine ring, a 1,2,3-triazole ring, a 1,2,4-triazole ring, a tetrazole ring, an oxazole ring, a thiazole ring, a pyridine ring, a piperidine ring, a piperazine ring, a 1,3,5-triazine ring, a pyrazolone ring, and a sulfolane ring.

The ring formed by Z is preferably a saturated hydrocarbon ring, particularly preferably a 5- to 7-membered ring, and most preferably a cyclohexane ring.

In the present invention, Formula (I) is represented preferably by the following Formula (I-1), more preferably by the following Formula (I-2):

(I-1)

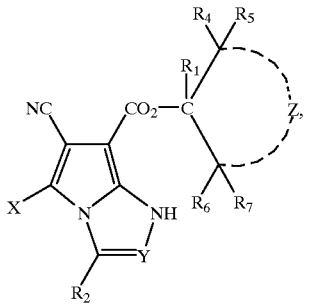

(I-2)

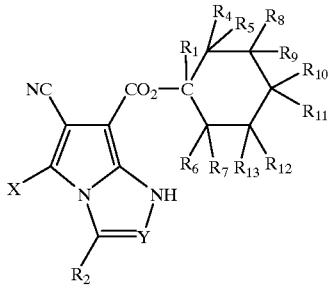

wherein X, Y, $R_1$, and $R_2$ are synonymous with those defined in Formula (I), respectively; $Z_1$ is synonymons with Z defined in Formula (I); and $R_4$, $R_5$, $R_6$, $R_7$, $R_8$, $R_9$, $R_{10}$, $R_{11}$, $R_{12}$, and $R_{13}$ each represents a hydrogen atom or a substituent.

The substituents listed for $R_3$ are enumerated for the substituents for $R_4$, $R_5$, $R_6$, $R_7$, $R_8$, $R_9$, $R_{10}$, $R_{11}$, $R_{12}$, and $R_{13}$.

$R_4$ and $R_6$ each is preferably an aliphatic group having 1 to 30 carbon atoms, an aryl group having 6 to 30 carbon atoms, an alkoxy group having 1 to 30 carbon atoms, an aryloxy group having 6 to 30 carbon atoms, a halogen atom, an alkyl- or aryl-oxycarbonyl group, and a carbamoyl group. $R_4$ and $R_6$ each is more preferably the aliphatic group having 1 to 30 carbon atoms, the aryl group having 6 to 30 carbon atoms, the alkoxy group having 1 to 30 carbon atoms, and the aryloxy group having 6 to 30 carbon atoms, particularly preferably the aliphatic group having 4 to 30 carbon atoms, and most preferably the branched alkyl group having 4 to 30 carbon atoms.

$R_5$ and $R_7$ include preferably a hydrogen atom, a halogen atom, an alkyl group having 1 to 30 carbon atoms, an alkoxy group having 1 to 30 carbon atoms, an aryl group having 6 to 30 carbon atoms, an aryloxy group having 6 to 30 carbon atoms, an alkyl-, aryl- or heterocyclic ring-oxycarbonyl group, or an alkyl-, aryl- or heterocyclic ring-oxycarbonylamino group. $R_5$ and $R_7$ each is more preferably a hydrogen atom, an alkyl group having 1 to 30 carbon atoms, an alkoxy group having 1 to 30 carbon atoms, an aryl group having 6 to 30 carbon atoms, and an aryloxy group having 6 to 30 carbon atoms, particularly preferably the hydrogen atom.

The cyan coupler used in the present invention may contain further at least one coupler moiety of the cyan coupler represented by Formula (I) at X, $R_1$, $R_2$ or $R_3$ to form a bis- or tris-compound, a dimer or a higher polymer or may contain a polymer chain to form a homopolymer or a copolymer. A typical example of the homopolymer or copolymer having a polymer chain is a homopolymer or a copolymer of an addition polymerizable ethylenic unsaturated compound having the cyan coupler residue of the coupler represented by Formula (I). In this case, two or more kind of cyan color-developing repeting units having cyan coupler residues of the couplers represented by Formula (I) may be contained in a polymer, and the cyan coupler may be a copolymer containing as a copolymerizable component at least one of a non-color developing ethylenic monomer which does not participate in coupling with an oxidized product of an aromatic primary amine developing agent, such as acrylic ester, methacrylic ester, and maleic esters.

The cyan coupler of the present invention may have stereostructural isomers of $R_1$ to $R_{13}$ in some cases. In using the cyan coupler of the present invention, it may be either the mixture of these isomers or a single isomer.

The specific examples of the coupler of the present invention will be shown below but the present invention will not be limited thereto.

In chemical formulae in the present invention an alkyl group having no any symbols such as i, t and n means an n-alkyl group.

(1)

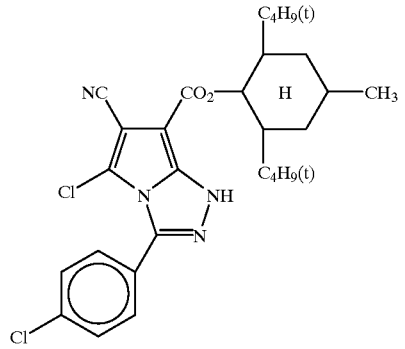

(2)

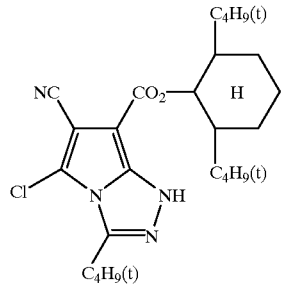

(3)

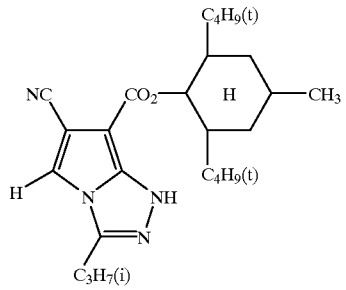

-continued
(4)
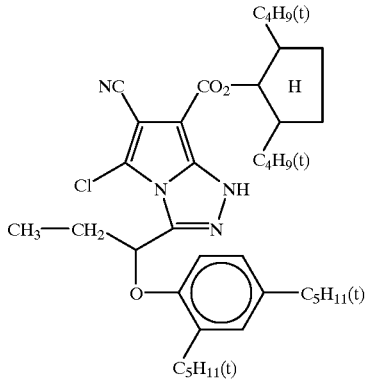
(5)
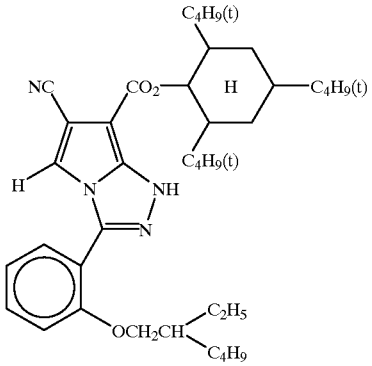
(6)
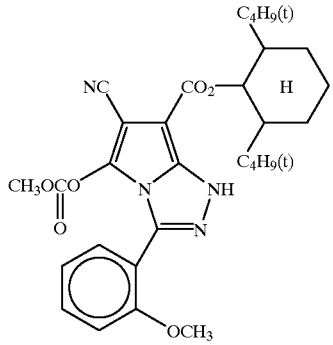
(7)
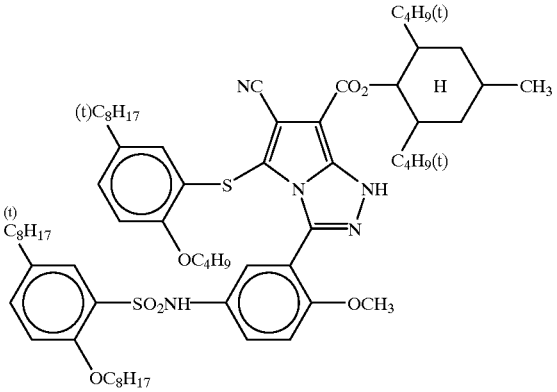
-continued
(8)
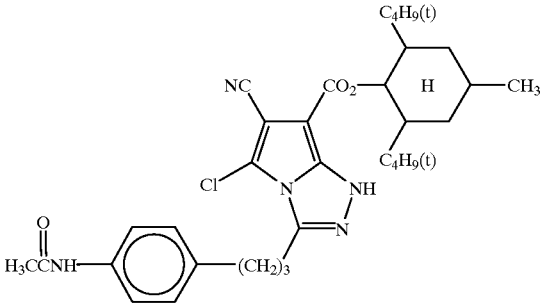
(9)
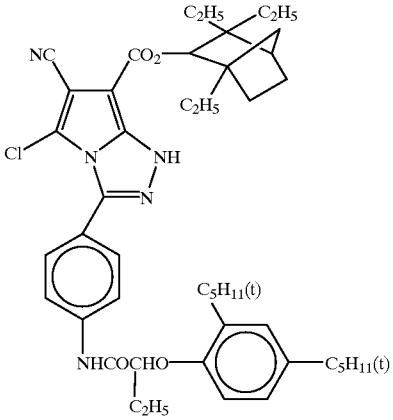
(10)
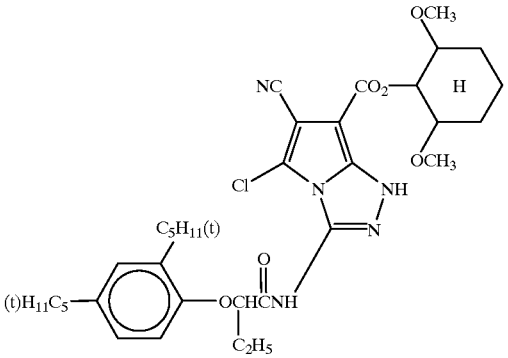
(11)
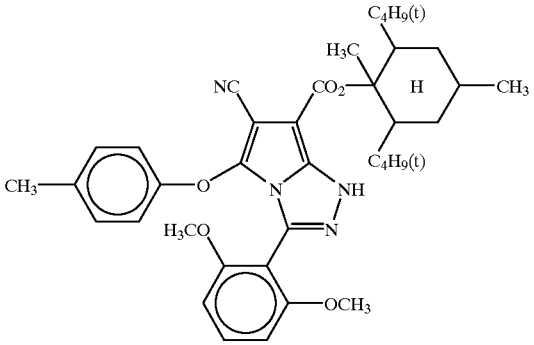

-continued
(12)
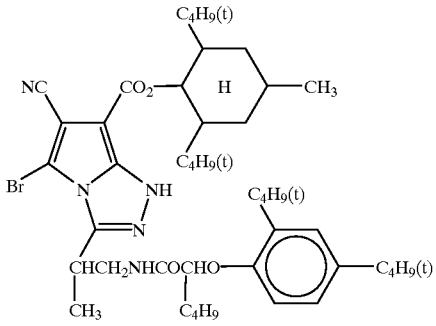
(13)
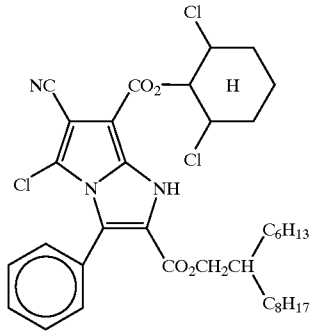
(14)
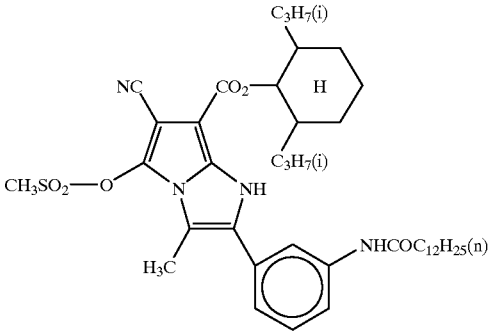
(15)
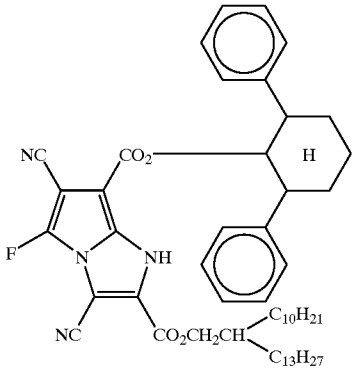
-continued
(16)
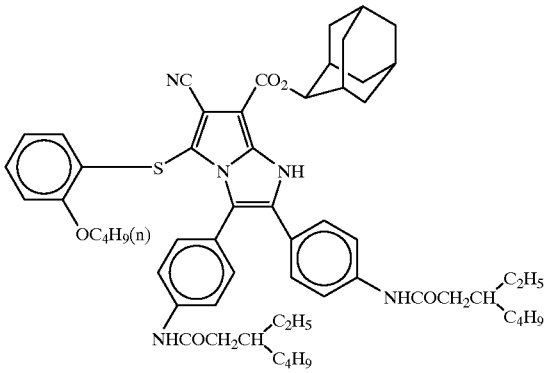
(17)
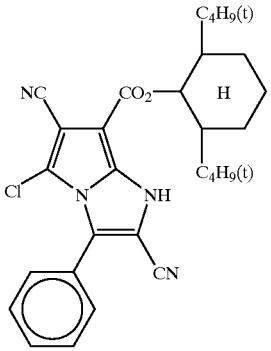
(18)
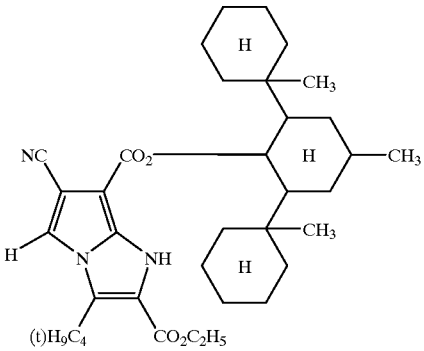
(19)
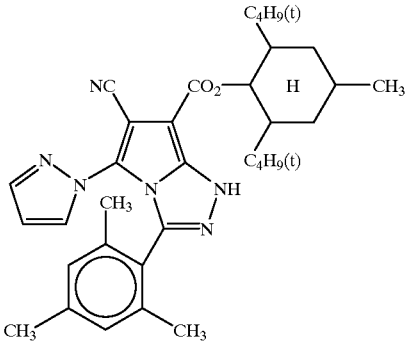

-continued
(20)
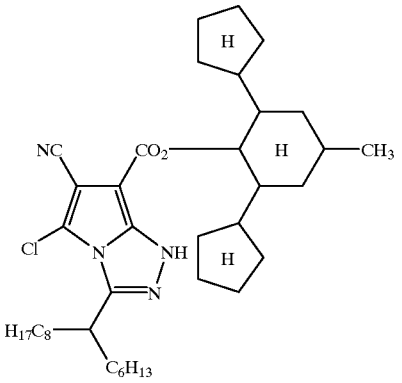
(21)
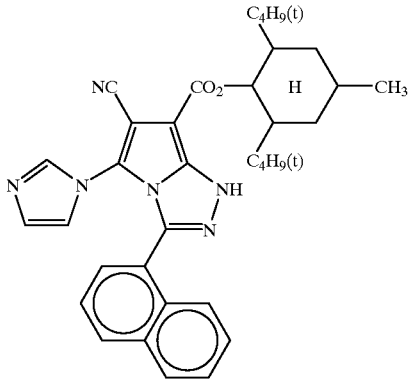
(22)
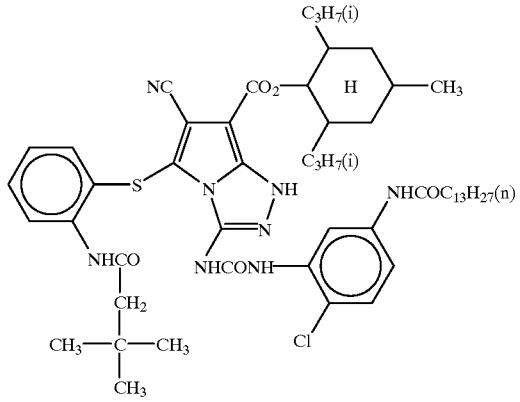
(23)
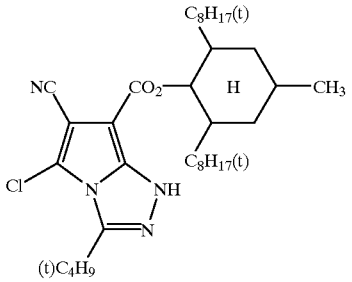
-continued
(24)
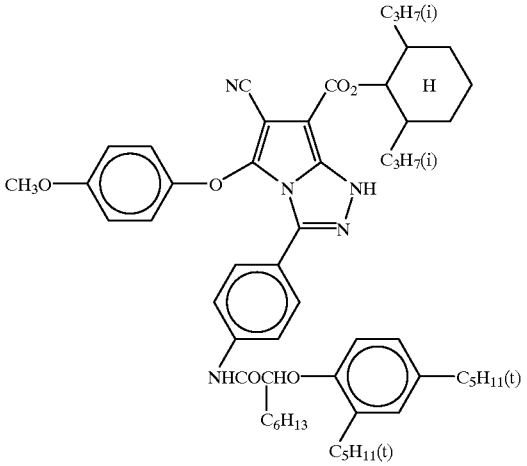
(25)
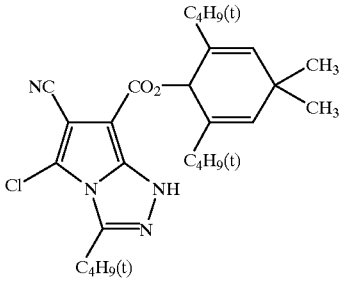
(26)
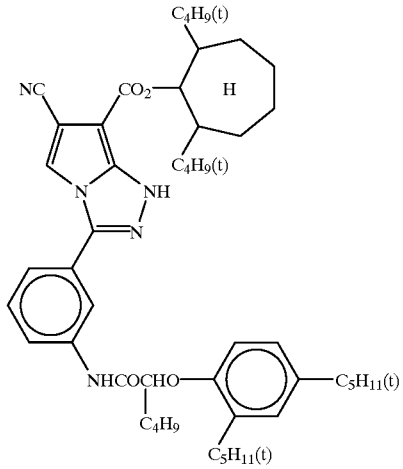
(27)
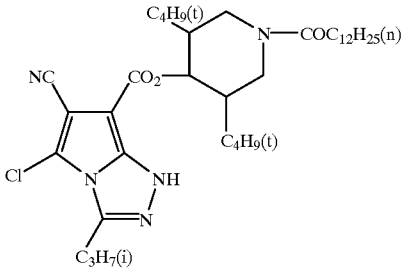

-continued
(28)
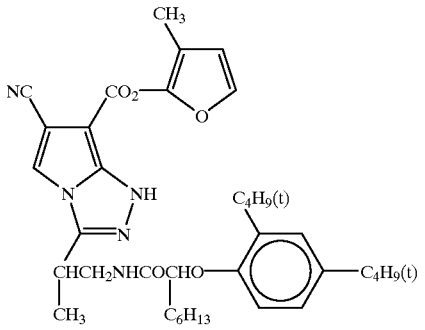
(29)
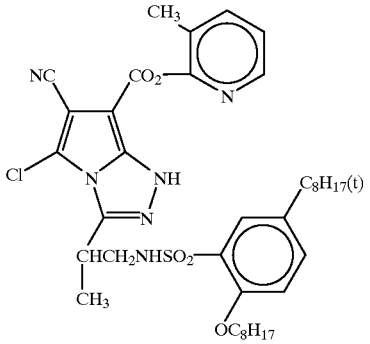
(30)
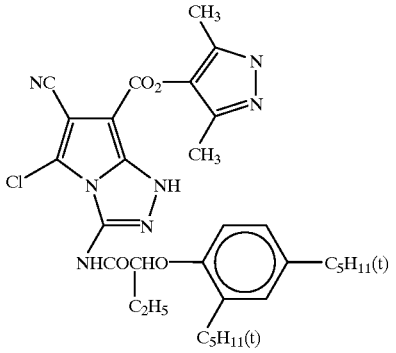
(31)
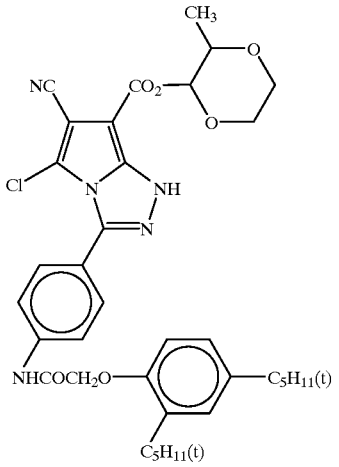
-continued
(32)
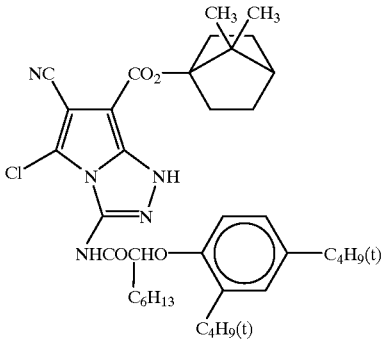
(33)
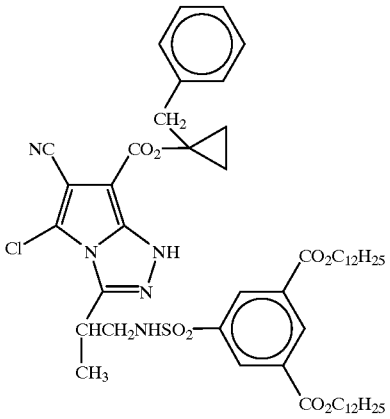
(34)
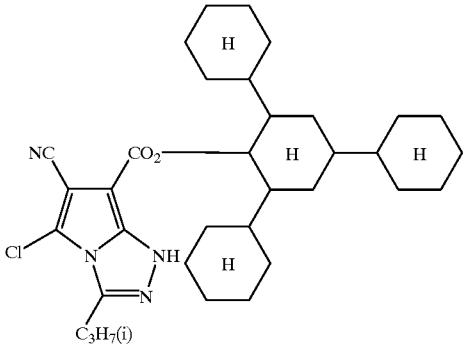
(35)
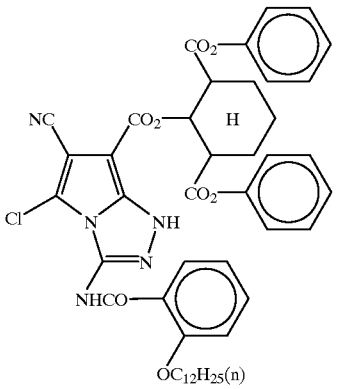

-continued (36)

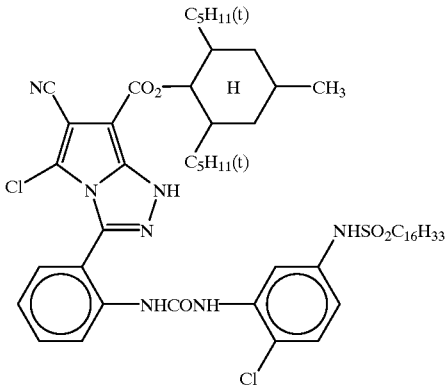

(37)

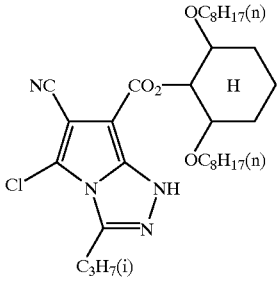

(38)

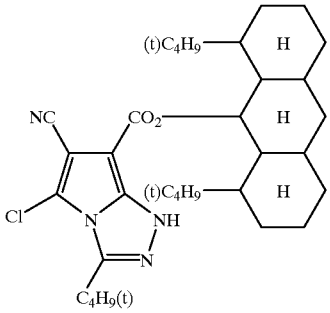

(39)

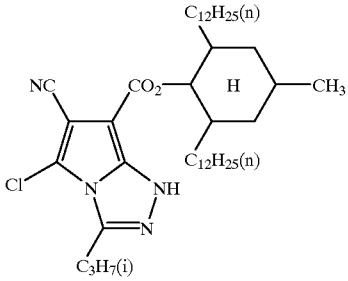

Next, the synthetic process of the compound of the present invention will be described.

The general synthetic process can be represented by the following scheme:

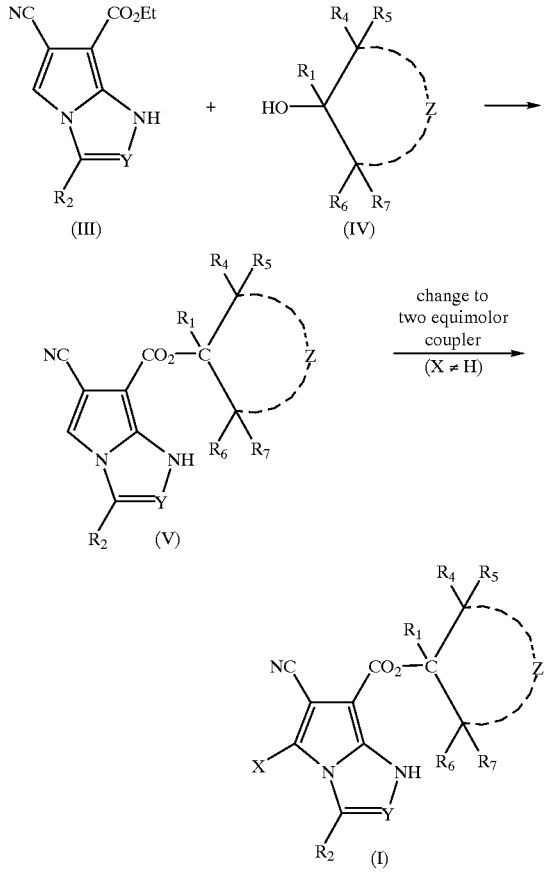

In each formulae $R_1$ to $R_7$, Y and Z are synonymous with those defined in Formulae (I-1) and (I-2).

The compound (III) can be synthesized by the process described in European Patent Publication 0488248A1 or the process represented by the following scheme:

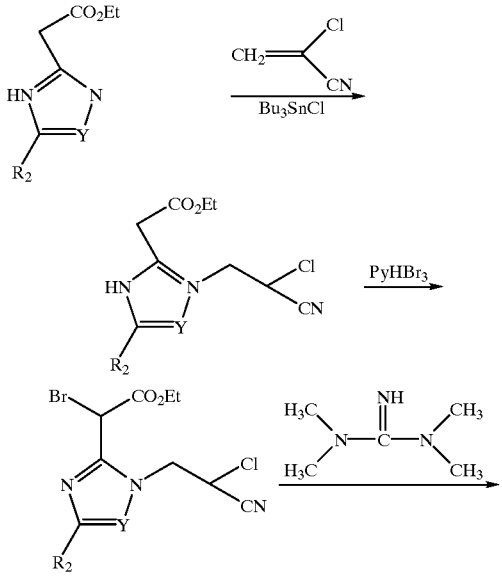

-continued

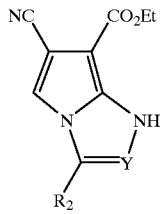

(III)

Next, the synthetic examples will be concretely shown.

SYNTHETIC EXAMPLE 1

Synthetic of the Exemplified Compound (1)

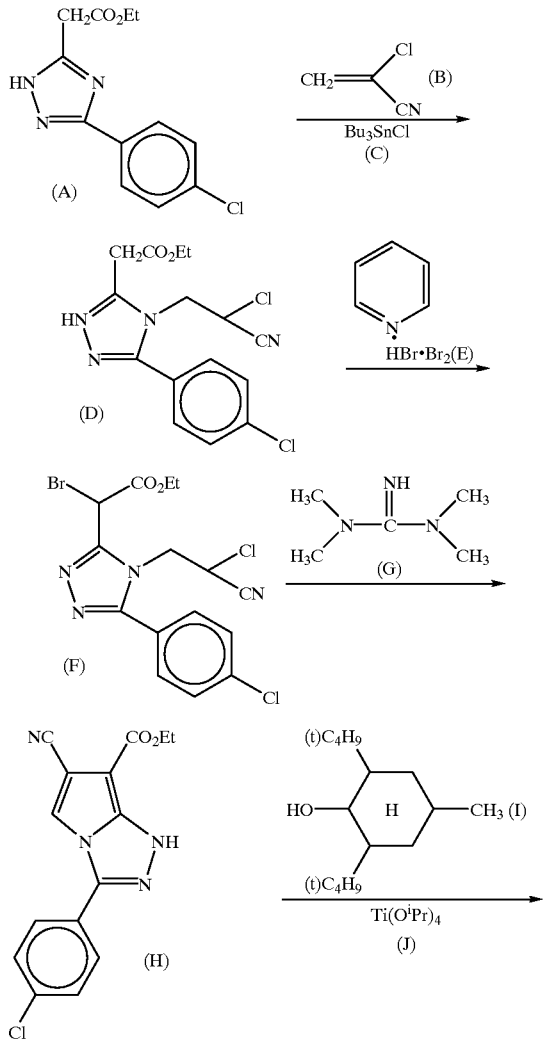

-continued

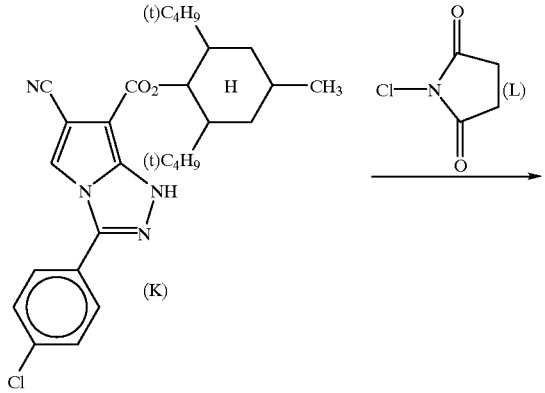

(1)

(A) (13.3 g) was dissolved in dimethylformamide (50 ml), and a 28% methanol solution (10 ml) of sodium methoxide was slowly added thereto. Further, (C) (16.3 g) was slowly added thereto while cooling the reaction mixture with water, and then stirred it for 15 minutes. Next, (B) (6.6 g) was dropped into the mixture, and then stirred it for 15 minutes. After completion of the reaction, ethyl acetate (100 ml) was added to the reaction mixture, and washed the mixture with water, followed by distilling the organic layer after drying it. The residue was refined with a column chromatography to thereby obtain (D) (8.5 g).

(E) (5.0 g) was added to tetrahydrofuran solution (25 ml) of (D) (5.0 g) thus obtained, and the solution was left for standing throughout a night. After completion of the reaction, ethyl acetate was added into the reaction mixture, and washed it with water, followed by distilling the organic layer after drying it. Dimethylformamide (50 ml) was added to the residue (F) thus obtained, and 1,1,3,3-tetramethylguanidine (G) (5.6 g) was slowly dropped thereto while keeping an inner temperature at −20° C. in a dry ice-methanol bath.

After completion of the reaction, ethyl acetate (100 ml) and water (100 ml) were added into the reaction mixture for extraction, and an organic layer was distilled after drying it. The residue was refined with a column chromatography to thereby obtain (H) (950 mg).

(H) (950 ml) thus obtained, (I) (3 g) and (J) (tetraisopropyl orthotitanate: 0.14 g) were dissolved in sulfolane (2 ml), and the mixture was heated at an inner temperature of 170° C. for 30 minutes. After completion of the reaction, the solution was cooled down, and ethyl acetate and water were added thereto, followed by filtrating with celite. After drying the mixture, the organic layer was distilled, and the residue was refined with a column chromatography to thereby obtain (K) (900 mg). (Yield: 60%).

(K) (900 mg) thus obtained was dissolved in tetrahydrofuran (5 ml), and (L) (0.24 g) was added into the solution, followed by further adding a 36% hydrochloric acid aqueous solution (3 drops). After completion of the reaction, ethyl acetate and water were added to the reaction mixture for extraction, and after drying it, the organic layer was distilled, followed by refining the residue with a column chromatography to thereby obtain the aimed exemplified compound (1) (880 mg).

SYNTHETIC EXAMPLE 2

Synthesis of the Exemplified Compound (2)

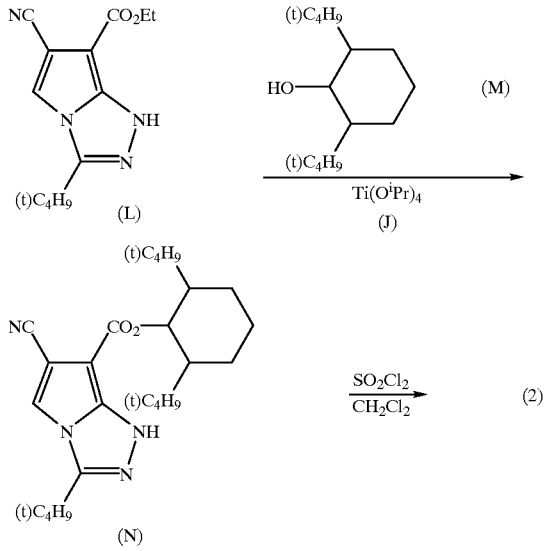

(L) (2.6 g), (M) (10 g) and (J) (0.5 g) were heated for 30 minutes while keeping an inner temperature at 170° C. After completion of the reaction, ethyl acetate and water were added, and the solution was filtrated with celite, followed by distilling the organic layer after drying it. The residue was refined with a column chromatography to thereby obtain (N) (2.5 g). (Yield: 60%).

(N) (2.5 g) thus obtained was dissolved in dichloromethane (25 ml), and sulfuryl chloride (0.8 g) was slowly dropped into the solution while cooling in an ice bath. After completion of the reaction, ethyl acetate and water were added for extraction, and the organic layer was dried. After distilling off ethyl acetate, the residue was refined with a column chromatography to thereby obtain the aimed exemplified compound (2) (0.75 g).

The other compounds of the present invention can be synthesized as well by the similar process.

The light-sensitive material of the present invention has at least one layer containing the cyan coupler of Formula (I) on a support. The layer containing the cyan coupler is a hydrophilic colloid layer provided on the support.

Examples of the hydrophilic colloid layer include a silver halide emulsion layer, an interlayer, an antihalation layer, an irradiation preventing layer, a protective laye, and an ultra violet absorbing layer. In general, the light-sensitive material can be of the constitution in which a blue-sensitive silver halide emulsion layer, a green-sensitive silver halide emulsion layer, and a red-sensitive silver halide emulsion layer are coated in this order on the support, but the order may be different from this. Further, at least one of the above light-sensitive emulsion layers can be replaced with an infrared-sensitive silver halide emulsion layer. The silver halide emulsions having the sensitivities in the respective wavelength regions and the couplers which form the dyes having the relationship of a complementary color with the rays to which the emulsions are sensitive can be incorporated into these light-sensitive emulsion layers to carry out a color reproduction by a subtractive color process. Provided that there may be taken the constitution in which the light-sensitive emulsion layers have no such the relationship as mentioned above with the hues of the dyes developed with the color couplers.

In the case where the cyan coupler according to the present invention is applied to the light-sensitive material, it is applied particularly preferably to the red-sensitive silver halide emulsion layer.

The content of the cyan coupler of the present invention in the light sensitive material is adequately $1\times10^{-3}$ to 1 mole, preferably $2\times10^{-3}$ to $2\times10^{-1}$ mole per mole of silver halide contained in the same layer.

The cyan coupler according to the present invention can be incorporated into the light-sensitive material by various conventional dispersing methods. Preferred is an oil-in-water dispersing method in which they are dissolved in a high boiling solvent (a low boiling solvent is used in combination according to necessity) and are emulsified and dispersed in a gelatin aqueous solution and add the dispersion into a silver halide emulsion.

The examples of the high boiling solvent used in the oil-in-water dispersion method are described in U.S. Pat. No. 2,322,027. The step and effect of a latex dispersing method as one of the polymer dispersing methods and the concrete examples of a latex for impregnation are described in U.S. Pat. No. 4,199,363, German Patent Applications (OLS) 2,541,274 and 2,541,230, JP-B-53-41091 (the term "JP-B" as used herein means an examined Japanese patent publication), and European Patent Publication 029104, and further, a dispersion method using an organic solvent soluble polymer is described in PCT International Patent Publication No. WO88/00723.

The high boiling organic solvent which can be used in the above oil-in-water dispersion method includes phthalic esters (for example, dibutyl phthalate, dioctyl phthalate, dicyclohexyl phthalate, di-2-ethylhexyl phthalate, decyl phthalate, bis(2,4-di-tert-amylphenyl)isophthalate, and bis (1,1-di-ethylpropyl)phthalate), phosphoric or phosphonic esters (for example, diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, and di-2-ethylhexylphenyl phosphate), benzoic esters (for example, 2-ethylhexyl benzoate, 2,4-dichlorobenzoate, dodecyl benzoate, and 2-ethylhexyl-p-hydroxybenzoate), amides (for example, N,N-diethyl dodecanamide and N,N-diethyl laurylamide), alcohols or phenols (for example, isostearyl alcohol and 2,4-di-tert-amylphenol), aliphatic esters (for example, dibutoxyethyl succinate, di-2-ethylhexyl succinate, 2-hexyldecyl tetradecanate, tributyl citrate, diethyl azelate, isostearyl lactate, and trioctyl citrate), an aniline derivative for example, N,N-dibutyl-2-butoxy-5-tert-octylaniline), chlorinated paraffins (for example, paraffins having a chlorine content of 10 to 80%), trimesic esters (for example, tributyl trimesate), dodecylbenzene, diisopropylnaphthalene, phenols (for example, 2,4-di-tert-amylphenol, 4-dodecyloxyphenol, 4-dodecyloxycarbonylphenol, and 4-(4-dodecyloxyphenylsulfonyl)phenol), carboxylic acids (for example, 2-(2,4-di-tert-amylphenoxy)butyric acid, and 2-ethoxyoctanedecanoic acid), and alkylphosphoric acids (for example, di-2(ethylhexyl)phosphoric acid and diphenylphosphoric acid). Further, there may be used in combination as an auxiliary solvent, an organic solvent having a boiling point of 30° C. or higher and about 160° C. or lower (for example, ethyl acetate, butyl acetate, ethyl propionate, methyl ethyl ketone, cyclohexanone, 2-ethoxyethyl acetate, and dimethylformamide).

The high boiling solvents can be used in an amount of 0 to 10.0 times, preferably 0 to 5.0 times, and more preferably 0.5 to 4.5 times an amount of a coupler by weight ratio.

Examples of preferred silver halide used in the present invention include silver chloride, silver bromide, silver chlorobromide, silver iodochlorobromide, and silver iodobromide. For the purpose of a rapid processing, particularly preferably used is an emulsion of silver chlorobromide containing substantially no silver iodide and having a silver chloride content of 90 mole % or more, more preferably 95 mole % or more, and particularly preferably 98 mole % or more, or pure silver chloride.

For the purpose of improving a sharpness of an image, the dyes (among them, an oxonol dye) capable of being decolored by processing, described at pages 27 to 76 of European Patent EP 0,337,490A2 are preferably added to a hydrophilic colloid layer of the light-sensitive material according to the present invention so that an optical reflection density of the light-sensitive material in 680 nm becomes 0.70 or more, and there is preferably incorporated into an water resistant resin layer of a support, titanium oxide which is subjected to a surface treatment with di- to tetrahydric alcohols (for example, trimethylolethane) in a proportion of 12% by weight or more (more preferably 14% by weight or more).

In the light-sensitive material according to the present invention, the color image preservability-improving compounds described in European Patent EP0,277,589A2 are preferably used together with couplers. In particular, they are used preferably in combination with a pyrazoloazole magenta coupler.

That is, preferably used simultaneously or singly for preventing side effects of, for example, the generation of stain and others due to a color-developed dye formed by a reaction of a color developing agent or the oxidized product thereof remained in a layer during storage after processing with a coupler are the compound (F) which is chemically combined with an aromatic amine developing agent remained after a color development processing to form a chemically inactive and substantially colorless compound, and/or the compound (G) which is chemically combined with an oxidized product of the aromatic amine developing agent remained after the color development processing to form a chemically inactive and substantially colorless compound.

Further, the anti-mold agents such as those described in JP-A-63-271247 are preferably added to the light-sensitive material according to the present invention for the purpose of preventing various molds and bacteria which grow in a hydrophilic colloid layer to deteriorate an image.

There may be used as a support used for the light-sensitive material according to the present invention for display, a white polyester support or a support in which a layer containing a white pigment is provided on the support side having a silver halide emulsion layer. Further, an antihalation layer is preferably provided on the support side coated thereon with the silver halide emulsion layer or the backside thereof in order to improve a sharpness. In particular, a transmission density of a support is settled preferably in a range of 0.35 to 0.8 so that a display can be appreciated with either a reflected light or a transmitted light.

The light-sensitive material according to the present invention may be exposed with either a visible ray or an infrared ray. An exposing manner may be either a low illuminance exposure or a high illuminance exposure for a short time. Particularly in the latter case, preferred is a laser scanning exposing method in which an exposing time per a picture element is shorter than $10^{-4}$ second.

In exposure, the band stop filter such as those described in U.S. Pat. No. 4,880,726 is preferably used, whereby a light mixture is removed to notably improve a color reproduction.

Those described in the following patent publications, particularly European Patent EP 0,355,660A2 are preferably used as the silver halide emulsions, other materials (the additives) and photographic constitutional layers (a layer arrangement) each applied in the present invention, and the processing methods and additives for processing, which are applied for processing this light-sensitive material:

TABLE 1

| Photographic elements | JP-A-62-215272 | JP-A-2-33144 | EP 0,355,660A2 |
|---|---|---|---|
| Silver halide emulsion | P.10, right upper colmn, line 6 to P. 12, left lower colmn, line 5, and P. 12, right lower colmn, line 4 from bottom to P. 13, left upper colmn, line 17. | P. 28, right upper colmn, line 16 to P. 29, right lower colmn, line 11, and P. 30, line 2 to 5. | P. 45, line 53 to P. 47, line 3, and P. 47, line 20 to 22. |
| Silver halide solvent | P. 12, left lower colmn, line 6 to 14, and P. 13, left upper colmn, line 3 from bottom to P. 18, left lower colmn, last line. | — | — |
| Chemical sensitizer | P. 12, left lower colmn, line 3 from bottom to right lower colmn, line 5 from bottom, and P. 18, right lower colmn, line 1 to P. 22, right upper colmn, line 9 from bottom. | P. 29, right lower colmn, line 12 to last line. | P. 47, lines 4 to 9. |
| Spectral sensitizer (spectral sensitizing process) | P. 22, right upper colmn, line 8 from bottom to P. 38, last line. | P. 30, left upper colmn, line 1 to 13. | P. 47, line 10 to 15. |
| Emulsion stabilizer | P. 39, left upper column, line 1 to P. 72, right upper colmn, last line. | P. 30, left upper colmn, line 14 to right upper column, line 1. | P. 47, line 16 to 19. |
| Development | P. 72, left lower colmn, | — | — |

TABLE 1-continued

| Photographic elements | JP-A-62-215272 | JP-A-2-33144 | EP 0,355,660A2 |
|---|---|---|---|
| accelerator | line 1 to P. 91, right upper colmn, line 3. | | |
| Color coupler (cyan, magenta and yellow couplers) | P. 91, right upper colmn, line 4 to P. 121, left upper column, line 6. | P. 3, right upper colmn, line 14 to P. 18, left upper colmn, last line, and P. 30, right upper column, line 6 to P. 35 right lower colmn, line 11. | P. 4, line 15 to 27, P. 5, line 30 to P. 28, last line, P. 45, line 29 to 31, and P. 47, line 23 to P. 63, line. 50 |
| Color forming accelerator | P. 121, left lower colmn, line 7 to P. 125, right upper colmn, line 1. | — | — |
| UV absorber | P. 125, right upper colmn, line 2 to P. 127, left lower colmn, last line. | P. 37, right lower colmn, line 14 to P. 38, left upper colmn, line 11. | P. 65, line 22 to 31. |
| Anti-fading agent (image stabilizer) | P. 127, right lower colmn, line 1 to P. 137, left lower colmn, line 8. | P. 36, right upper colmn, line 12 to P. 37, left upper colmn, line 19. | P. 4, line 30 to P. 5, line 23, P. 29, line 1 to P. 45, line 33 to 40, P. 45, line 33 to 40, and P. 65, line 2 to 21. |
| High boiling and/or low boiling organic solvent | P. 137, left lower colmn, line 9 to P. 144, right upper, last line. | P. 35, right lower colmn line 14 to P. 36, left upper, line 4. | P. 64, line 1 to 51. |
| Process for dispersing photographic additives | P. 144, left lower colmn; line 1 to P. 146, right upper colmn, line 7. | P. 27, right lower colmn, line 10 to P. 28, left upper, last line, and P. 35, right lower colmn, line 12 to P. 36, right upper colmn, line 7. | P. 63, line 51 to P. 64, line 56. |
| Hardener | P. 146, right upper colmn, line 8 to P. 155, left lower column, line 4. | — | — |
| Precursor of a developing agent | P. 155, left lower colmn, line 5 to right lower. colmn, line 2. | — | — |
| Development inhibitor-releasing compound | P. 155, right lower colmn, lines 3 to 9. | — | — |
| Support | P. 155, right lower colmn, line 19 to P. 156, left upper colmn, line 14. | P. 38, right upper colmn, line 18 to P. 39, left upper colmn, line 3. | P. 66, line 29 to P. 67 line 13. |
| Light-sensitive layer structure | P. 156, left upper colmn, line 15 to right lower colmn, line 14. | P. 28, right upper colmn, line 1 to 15. | P. 45, line 41 to 52 |
| Dye | P. 156, right lower colmn, line 15 to P. 184, right lower colmn, last line. | P. 38, left upper colmn, line 12 to right upper colmn, line 7. | P. 66, line 18 to 22. |
| Anti-color mixing agent | P. 185, left upper colmn, line 1 to P. 188, right lower colmn, line 3. | P. 36, right upper colmn, line 8 to 11. | P. 64, line 57 to P. 65 line 1. |
| Gradation controller | P. 188, right lower colmn, line 4 to 8. | — | — |
| Anti-stain agent | P. 188, right lower colmn, line 9 to P. 193, right lower colmn, line 10. | P. 37, left upper colmn, last line to right lower colmn, line 13. | P. 65, line 32 to P. 66, line 17. |
| Surface active agent | P. 201, left lower colmn, line 1 to P. 210, right upper colmn, last line | P. 18, right upper colmn, line 1 to P. 24, right lower colmn, last line, and P. 27, left lower colmn, line 10 from bottom to right lower colmn, line 9. | — |
| Fluorine-containing compound (anti-static agent, coating aid, lubricant and anti-adhesion agent) | P. 210, left lower colmn, line 1 to P. 222, left lower colmn, line 5. | P. 25, left upper colmn, line 1 to P. 27, right lower colmn, line 9. | |
| Binder (hydrophilic | P. 222, left lower colmn, line 6 to P. 225, left | P. 38, right upper colmn, line 8 to 18. | P. 66, line 23 to 28. |

TABLE 1-continued

| Photographic elements | JP-A-62-215272 | JP-A-2-33144 | EP 0,355,660A2 |
|---|---|---|---|
| colloid) | upper colmn, last line | | |
| Thickener | P. 225, right upper colmn, line 1 to P. 227, right upper colmn, line 2. | — | — |
| Anti-static agent | P. 227, right upper colmn, line 3 to P. 230, left upper colmn, line 1. | — | — |
| Polymer latex | P. 230, left upper colmn, line 2 to P. 239, last line | — | — |
| Matting agent | P. 240, left upper colmn, line 1 to right upper colmn, last line. | — | — |
| Photo-graphic processing process (processing steps and additives) | P. 3, right upper colmn, line 7 to P. 10, right upper colmn, line 5. | P. 39, left upper colmn, line 4 to P. 42, left upper colmn, last line. | P. 67, line 14 to P. 69, line 28. |

Remarks: the content amended according to the Amendment dated March 16, 1987 which is inserted at the end of this publication is included in the cited items of JP-A-62-215272.

Further, preferred as well are the silver halide color photographic light-sensitive materials and the processing methods thereof each described in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and European Patent 0520457A2.

The present invention will concretely be explained below with reference to the examples but the present invention will not be limited thereto.

EXAMPLE 1

A multilayered color photographic paper (Sample 104) having the layer constitution shown below on a paper support laminated on the both sides thereof with polyethylene were prepared. The coating solutions were prepared in the following manner.

Preparation of the Fifth Layer Coating Solution

Ethyl acetate (80 ml) was added to the cyan coupler (the exemplified compound 1: 20.0 g), the dye image stabilizer (Cpd-1) (30.0 g), the dye image stabilizer (Cpd-2) (5.0 g), the dye image stabilizer (Cpd-5) (8.0 g), the dye image stabilizer (Cpd-6) (1.0 g), the dye image stabilizer (Cpd-8) (10.0 g), the dye image stabilizer (Cpd-9) (1.0 g), the dye image stabilizer (Cpd-10) (15.0 g), the dye image stabilizer (Cpd-11) (1.0 g), the solvent (Solv-2) (35.0 g), the solvent (Solv-9) (35.0 g), and sodium dodecylbenzenesulfonate (5.0 g) to dissolve them, and this solution was emulsified and dispersed in a 20% gelatin aqueous solution with a high speed stirring emulsifier.

Silver chlorobromide emulsions of the large size emulsion $R_1$ and the small size emulsion $R_2$ were prepared. The average grain size of emulsions $R_1$ and $R_2$ were 0.55 $\mu$m and 0.48 $\mu$m, respectively, the fluctuation coefficients in the grain size distributions thereof were 0.06 and 0.08, respectively, and the respective emulsions comprise cuve silver halide grains in which silver bromide (0.5 mol %) was locally incorporated into a part of a grain surface and the rest was silver chloride.

Red-sensitive sensitizing dye E shown below was added to emulsions $R_1$ and $R_2$ in amounts of $1.0\times10^{-4}$ mole per mole of silver halide of the large size emulsion and $1.2\times10^{-4}$ mole per mole of silver halide of the small size emulsion, respectively. Emulsion C was prepared by mixing these two emulsions in a silver mole ratio of 5:5. A sulfur sensitizer and a gold sensitizer were added to Emulsion C to subject it to chemical ripening. The foregoing emulsified dispersion and this emulsion were mixed and dissolved, to prepare the fifth layer coating solution having the composition shown below.

The coating solutions for the 1st layer to 7th layer were prepared in the same manner as the fifth layer coating solution. Sodium 1-oxy-3,5-dichloro-s-triazine was used as a gelatin hardener for the respective layers.

Further, Cpd-14 and Cpd-15 were added to the respective layers so that the total amounts became 25.0 mg/m$^2$ and 50.0 mg/m$^2$, respectively.

The silver chlorobromide emulsions for the respective light-sensitive emulsion layers were prepared in the same preparing process as the silver chlorobromide emulsion C described above, except that the sizes and the compositions were changed and the spectral sensitizing dyes shown below were used.

Blue-Sensitive Emulsion Layer

Sensitizing dye A

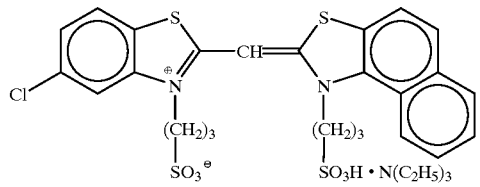

and

Sensitizing dye B

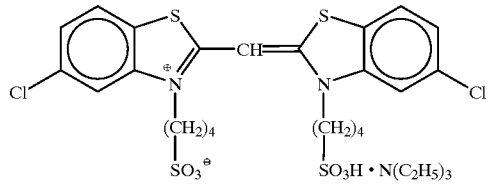

(each $2.0\times10^{-4}$ mole per mole of silver halide to the large size emulsion and each $2.5\times10^{-4}$ mole per mole of silver halide to the small size emulsion.)

Green-Sensitive Emulsion Layer

Sensitizing dye C

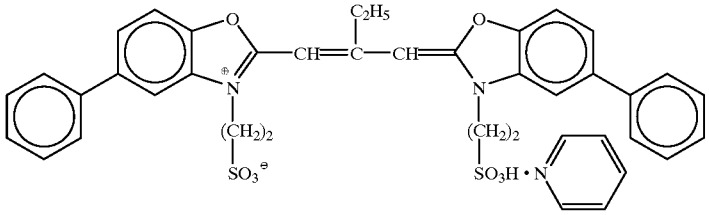

($4.0\times10^{-4}$ mole per mole of silver halide to the large size emulsion and $5.6\times10^{-4}$ mole per mole of silver halide to the small size emulsion.)

Sensitizing dye D

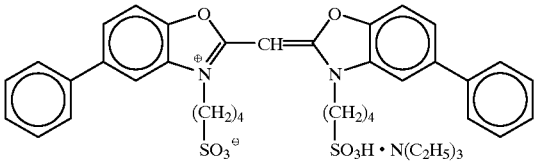

($7.0\times10^{-5}$ mole per mole of silver halide to the large size emulsion and $1.0\times10^{-4}$ mole per mole of silver halide to the small size emulsion.)

Red-Sensitive Emulsion Layer

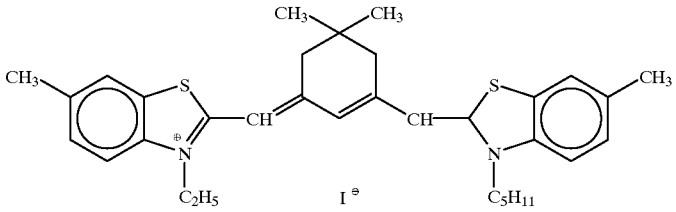

($1.0\times10^{-4}$ mole per mole of silver halide to the large size emulsion and $1.2\times10^{-4}$ mole per mole of silver halide to the small size emulsion.)

Further, the following compound was added in the amount of $2.6\times10^{-3}$ mole per mole of silver halide:

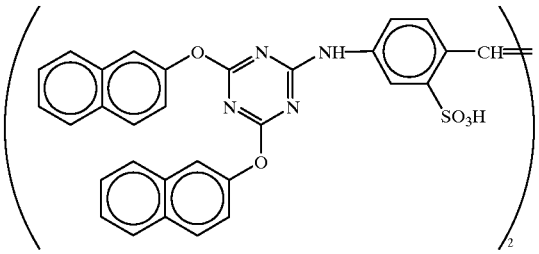

Further, 1-(5-methylureidophenyl)-5-mercaptotetrazole was added to a blue-sensitive layer, a green-sensitive layer and a red-sensitive layer in the amounts of $2.5\times10^{-3}$ mole, $4.0\times10^{-3}$ mole and $3.0\times10^{-4}$ mole each per mole of silver halide, respectively.

Further, 4-hydroxy-6-methyl-1,3,3a,7-tetrazaindene was added to the blue-sensitive layer and the green-sensitive layer in the amounts of $1\times10^{-4}$ mole and $2\times10^{-4}$ mole each per mole of silver halide, respectively.

The following dyes (the numeral in the parenthesis represents a coated amount) were added to the emulsion layers to prevent an irradiation:

Sensitizing dye E

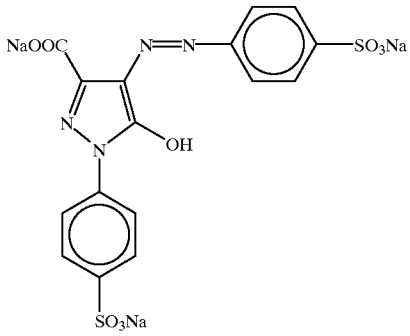

(10 mg/m$^2$)

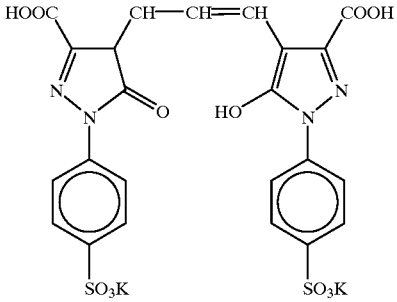

(10 mg/m$^2$)

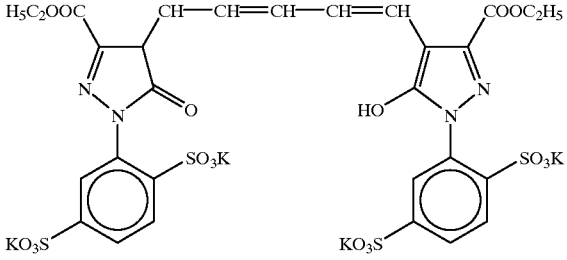

(40 mg/m$^2$)

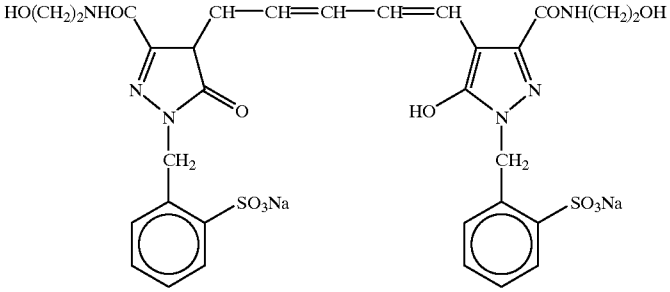

(20 mg/m$^2$)

Layer Constitution

The compositions of the respective layers are shown below. The numerals represent the coated amounts (g/m$^2$). The coated amounts of the silver halide emulsions are expressed in terms of the amounts converted to silver.

Support

Polyethylene-laminated paper.

A white pigment (TiO2: content 14 weight %) and a blue dye (ultramarine) were contained in polyethylene provided on a light-sensitive layer side. A center line surface roughness on the light-sensitive layer side of the support was 0.13 μm.

| First layer (a blue-sensitive emulsion layer): | |
|---|---|
| Silver chlorobromide emulsion A (cube, 3:7 mixture (silver mole ratio) of a large size emulsion having an average grain size of 0.88 μm and a small size emulsion having an average grain size of 0.70 μm, wherein the fluctuation coefficients in the grain size distributions were 0.08 and 0.10, respectively, and in either size emulsions, silver bromide (0.3 mol %) was locally incorporsted into a part of a grain surface; 0.1 mg (in total) of potassium hexachloroiridate (IV) and 1.0 mg (in total) of potassium ferrocyanate were incorporated into a grain inside and a silver bromide localized phase) | 0.24 |
| Gelatin | 1.36 |
| Yellow coupler (ExY) | 0.65 |
| Dye image stabilizer (Cpd-1) | 0.16 |
| Dye image stabilizer (Cpd-2) | 0.08 |
| Dye image stabilizer (Cpd-3) | 0.08 |
| Solvent (Solv-1) | 0.13 |
| Solvent (Solv-5) | 0.13 |

-continued

| | |
|---|---|
| Second layer (an color mixing preventing layer): | |
| Gelatin | 0.80 |
| Color mixing preventing agent (Cpd-4) | 0.11 |
| Solvent (Solv-7) | 0.03 |
| Solvent (Solv-2) | 0.25 |
| Solvent (Solv-3) | 0.25 |
| Third layer (a green-sensitive emulsion layer): | |
| Silver chlorobromide emulsion (cube, 1:3 mixture (silver mole ratio) of a large size emulsion having an average grain size of 0.55 μm and a small size emulsion having an average grain size of 0.39 μm, wherein the fluctuation coefficients in the grain size distributions were 0.10 and 0.08, respectively, and in either size emulsions, silver bromide (0.8 mol %) was locally incorporsted into a part of a grain surface; 0.2 mg (in total) of potassium hexachloroiridate (IV) and 1.0 mg (in total) of potassium ferrocyanate were incorporated into a grain inside and a silver bromide-localized phase; and a sulfur sensitizer and a gold sensitizer were added in the presence of a decomposition product of nucleic acid to subject the emulsion to a chemical sensitization) | 0.13 |
| Gelatin | 1.40 |
| Magenta coupler (ExM) | 0.18 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.20 |
| Solvent (Solv-4) | 0.35 |
| Solvent (Solv-8) | 0.35 |
| Fourth layer (a color mixing preventing layer): | |
| Gelatin | 0.65 |

-continued

| | |
|---|---|
| Color mixing preventing agent (Cpd-4) | 0.08 |
| Solvent (Solv-7) | 0.02 |
| Solvent (Solv-2) | 0.18 |
| Solvent (Solv-3) | 0.18 |
| Fifth layer (a red-sensitive emulsion layer): | |
| Silver chlorobromide emulsion C described above | 0.13 |
| Gelatin | 1.61 |
| Cyan coupler (Exemplified Compound 1) | 0.20 |
| Dye image stabilizer (Cpd-1) | 0.30 |
| Dye image stabilizer (Cpd-2) | 0.05 |
| Dye image stabilizer (Cpd-5) | 0.08 |
| Dye image stabilizer (Cpd-6) | 0.01 |
| Dye image stabilizer (Cpd-8) | 0.10 |
| Dye image stabilizer (Cpd-9) | 0.01 |
| Dye image stabilizer (Cpd-10) | 0.15 |
| Dye image stabilizer (Cpd-11) | 0.01 |
| Solvent (Solv-2) | 0.35 |
| Solvent (Solv-9) | 0.35 |
| Sixth layer (a UV absorbing layer): | |
| Gelatin | 0.50 |
| UV absorber (UV-1) | 0.38 |
| Dye image stabilizer (Cpd-5) | 0.02 |
| Dye image stabilizer (Cpd-12) | 0.15 |
| Seventh layer (a protective layer): | |
| Gelatin | 1.00 |
| Acryl-modified copolymer of polyvinyl alcohol (a modification degree: 17%) | 0.05 |
| Liquid paraffin | 0.02 |
| Dye image stabilizer (Cpd-13) | 0.01 |

(ExY) Yellow coupler

The couplers (1), (2), (3) and (4) each were mixed by 25% (mole ratio).

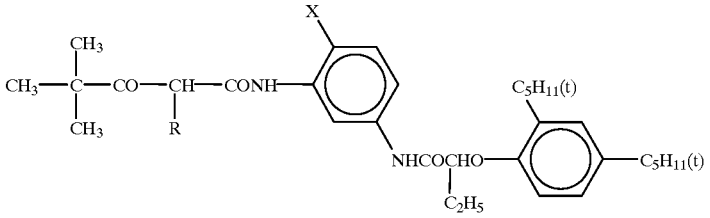

①

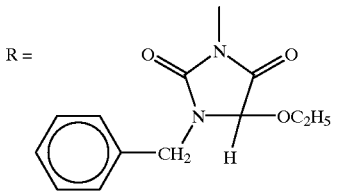

X = Cl

②

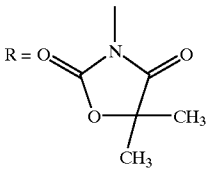

X = $OCH_3$

③

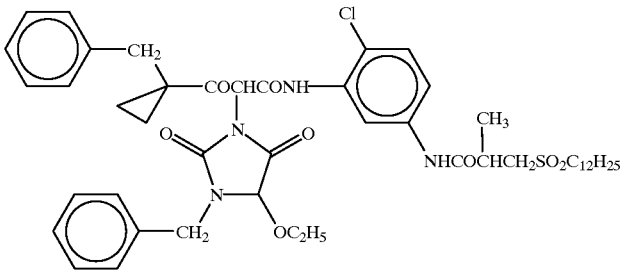

-continued
④
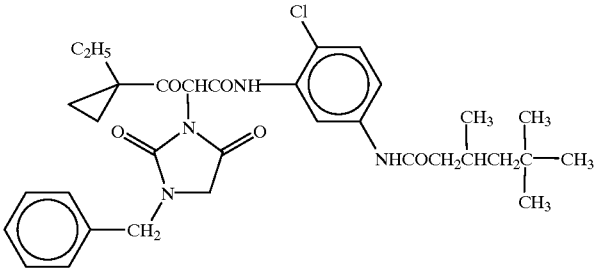
(ExM) Magenta coupler
1:1 (mole ratio) mixture of (1) and (2):
①
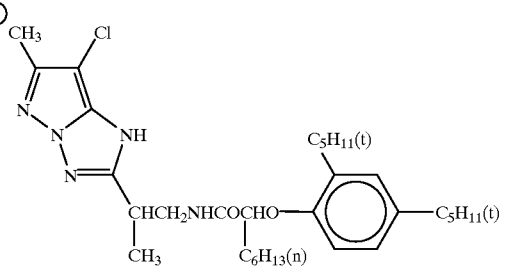
②
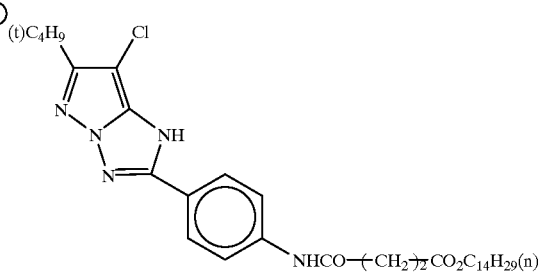
(Cpd-1) Dye image stabilizer
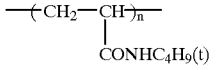
Average molecular weight: 60,000
(Cpd-2) Dye image stabilizer
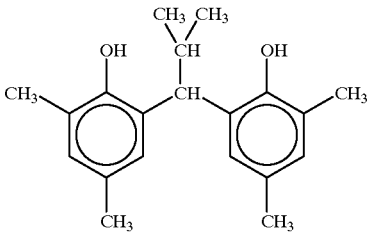
(Cpd-3) Dye image stabilizer
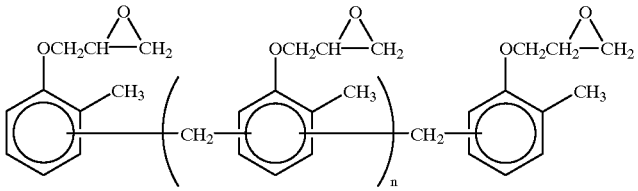
(a mixture of $n$ = 7 and 8)

-continued
(Cpd-4) Color mixing preventing agent
Mixture of (1), (2) and (3) = 1:1:1 (mole ratio)
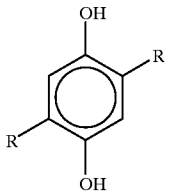
R: (1) $C_8H_{17}$ (t)
(2) $C_{15}H_{31}$ (t)
(3) $C_{14}H_{29}$ (sec)
(Cpd-5) Dye image stabilizer
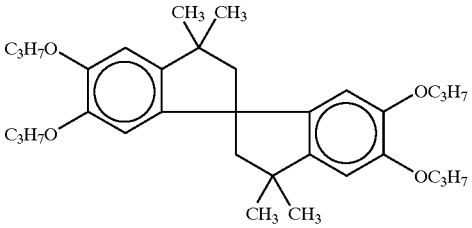
(Cpd-6) Dye image stabilizer
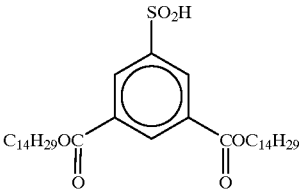
(Cpd-7) Dye image stabilizer
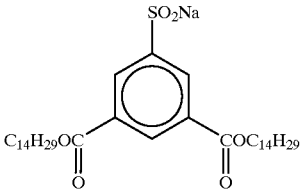
(Cpd-8) Dye image stabilizer
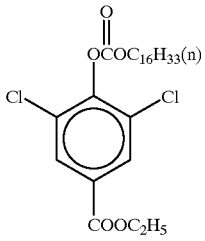
(Cpd-9) Dye image stabilizer
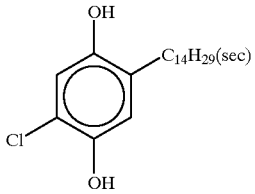
(Cpd-10) Dye image stabilizer
1:1:2:1 (weight ratio) mixture of (i),
(ii), (iii) and (iv):
(i)
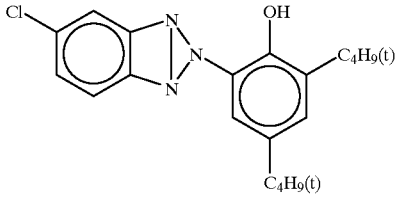
(ii)
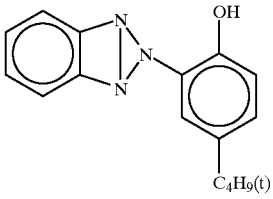
(iii)
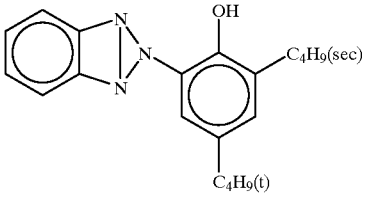
(iv)
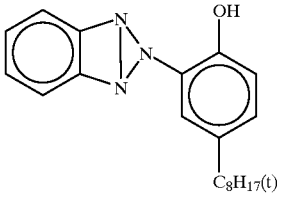

-continued
(Cpd-11) Dye image stabilizer
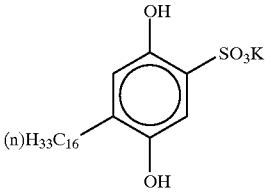
(Cpd-12) Dye image stabilizer
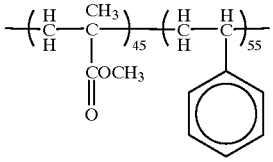
Average molecular weight: about 60,000
(45:55: molar ratio)
(Cpd-13) Dye image stabilizer
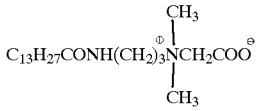
(Cpd-14) Preservative
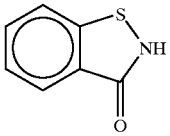
(Cpd-15) Preservative
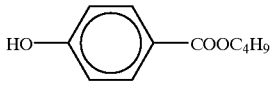
(UV-1) UV absorber
1:5:10:5:5 (weight ratio) mixture of
(i), (ii), (iii), (iv) and (v):
(i)
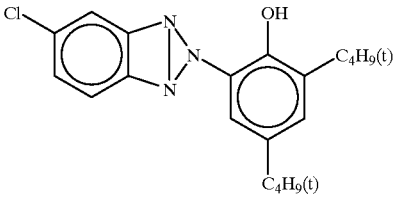
(ii)
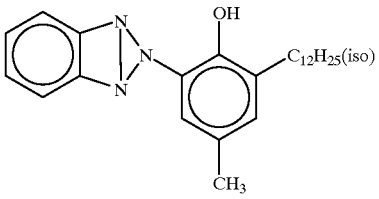
(iii)
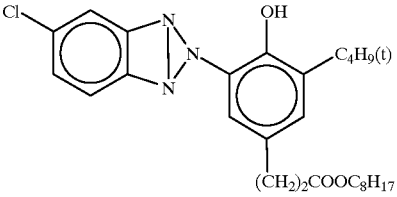
(iv)
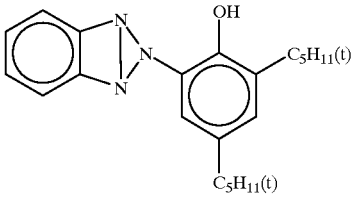
(v)
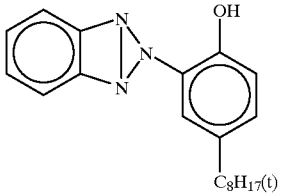
(Solv-1) Solvent
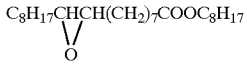
(Solv-2) Solvent
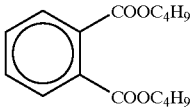
(Solv-3) Solvent
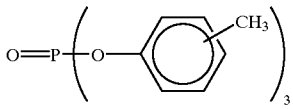
(Solv-4) Solvent
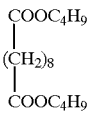

-continued (Solv-5) Solvent

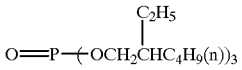

(Solv-7) Solvent

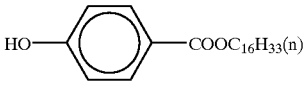

(Solv-8) Solvent

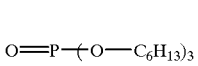

(Solv-9) Solvent

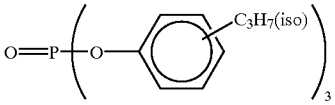

(a mixture)

Samples 101 to 108 were prepared in the same manner as Sample 104, except that the coupler contained in the fifth layer was changed as shown in Table A.

The light-sensitive materials thus prepared were exposed and processed as follows:

Exposure

A sensitometer (Model FWH manufactured by Fuji Photo film Co., Ltd.; a color temperature of a light source: 3200° K.) was used for Sample 102, and the exposure was given so that about 30% of a coated silver amount was developed to give gray.

The samples exposed were subjected to a development processing with a paper processing equipment at the processing steps shown below until the total replenishing solution of a color developing solution reached twice amount as much as a tank capacity.

| Processing Step | Temperature | Time | Replenishing amount* | Tank capacity |
|---|---|---|---|---|
| Color developing | 38.5° C. | 45 seconds | 73 ml | 10 l |
| Bleach/fixing | 35° C. | 45 seconds | 60 ml | 10 l |
| Rinsing (1) | 35° C. | 20 seconds | — | 5 l |
| Rinsing (2) | 35° C. | 20 seconds | — | 5 l |
| Rinsing (3) | 30 to 35° C. | 20 seconds | 360 ml | 5 l |
| Drying | 70 to 80° C. | 60 seconds | | |

*Replenishing amount: per $m^2$ of the light-sensitive material.
(Rinsing was of a three tank countercurrent system from (3) to (1)).

The compositions of the respective processing solutions are as follows:

| Color developing solution | Tank solution | replenishing solution |
|---|---|---|
| Water | 700 ml | 700 ml |
| Sodium triisopropylnaphthalene-(β)sulfonate | 0.1 g | 0.1 g |
| Ethylenediaminetetraacetic acid | 3.0 g | 3.0 g |
| Di sodium 1,2-dihydroxybenzene-4,6-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27 g | 27 g |
| Fluorescent whitening agent (Whitex 4B manufactured by Sumitomo Chem. Ind. Co., Ltd.) | 1.0 g | 3.0 g |
| Sodium sulfite | 0.1 g | 0.1 g |
| Disodium N,N-bis(sulfonate-ethyl)hydroxylamine | 10.0 g | 13.0 g |
| N-ethyl-N-(b-methanesulfon- | 5.0 g | 11.5 g |

-continued

| Color developing solution | Tank solution | replenishing solution |
|---|---|---|
| amidethyl)-3-methyl-4-aminoaniline sulfate | | |
| Water was added to | 1000 ml | 1000 ml |
| pH (25° C.) | 10.00 | 11.00 |
| Bleach/fixing solution | | |
| Water | 600 ml | 600 ml |
| Ammonium thiosulfate (700 g/liter) | 100 ml | 250 ml |
| Ammonium sulfite | 20 g | 100 g |
| Iron (III) ammonium ethylenediaminetetraacetate | 55 g | 135 g |
| Disodium ethylenediaminetetraacetate | 5 g | 12.5 g |
| Nitric acid (67%) | 30 g | 65 g |
| Water was added to | 1000 ml | 1000 ml |
| pH (25° C.) | 5.80 | 5.60 |

Rinsing Solution

Ion-exchanged water (contents of calcium and magnesium: each 3 ppm or lower)

Next, gradational exposure was given to the respective samples with the sensitometer described above via a color separation filter, and then they were subjected to a development processing in the solutions obtained after the continuous processing described above. These samples were subjected to the following evaluations:

Evaluation 1. Hue (Y/C)

In the cyan color-developing layer, a yellow density at a point providing a cyan density of 1.0 was measured with an X-Rite 310 densitometer (manufactured by X-Rite Company). It is shown that the lower this yellow density, the less the sub-absorption and the more excellent the hue.

Evaluation 2. Change in a Color-Developing Density Due to Change in a Blix Solution Composition In the processing solutions obtained after the continuous processing described above, the processing was carried out in two kinds of the bleach-fixing solution; one was the bleach-fixing solution of the tank solution composition before the continuous processing and another was that of a composition in which an ammonium thiosulfate amount and an ammonium sulfite amount were doubly increased. Reduction in a maximum color-developing density of cyan due to change in the bleach-fixing solution is shown by percentage.

Evaluation 3. Image Fastness

The samples obtained after the processing were kept at 100° C. and a relative humidity of 40% for 2 days and at 80° C. and a relative humidity of 70% for 6 days, and a density before and after storage was measured at a point providing an initial density of 0.6. The density after storage is shown by percentage with respect to the density before storage.

Evaluation 4. Color Fog

A reflection density of cyan at an unexposed area was measured by the X-Rite 310 densitometer.

The evaluation results of Samples 101 to 108 are shown in Table A.

TABLE A

| Sample No. | Coupler | Hue (Y/C) | Color-developing density change due to variation of blix solution composition | Image fatness 100° C. 400% RH | Image fatness 80° C. 70% RH | Image fatness Color fog |
|---|---|---|---|---|---|---|
| 101 (Comp.) | Comparative compound (1) | 0.180 | 11 | 76 | 73 | 0.141 |
| 102 (Comp.) | Comparative compound (2) | 0.180 | 11 | 76 | 73 | 0.101 |
| 103 (Comp.) | Comparative compound (3) | 0.180 | 8 | 75 | 70 | 0.100 |
| 104 (Inv.) | Exemplified compound (1) | 0.170 | 1 | 90 | 90 | 0.088 |
| 105 (Inv.) | Exemplified compound (2) | 0.170 | 0 | 90 | 90 | 0.088 |
| 106 (Inv.) | Exemplified compound (6) | 0.170 | 1 | 90 | 90 | 0.090 |
| 107 (Inv.) | Exemplified compound (12) | 0.170 | 1 | 91 | 90 | 0.090 |
| 108 (Inv.) | Exemplified compound (19) | 0.170 | 0 | 91 | 90 | 0.090 |

[Ka 29]

Comparative compound (1)

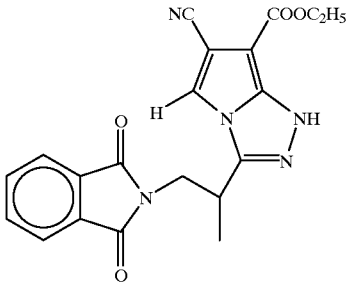

Compound (49) described in European Patent 0488248A1

Comparative compound (2)

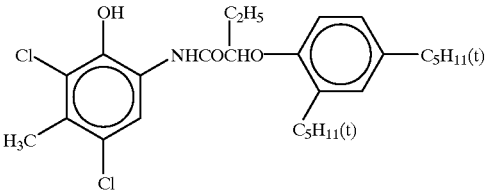

Comparative compound (3)

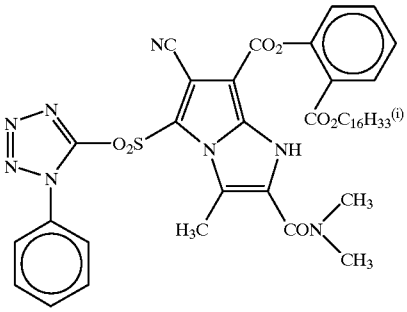

Compound (6) described in JP-A-5-232649

It can be found from the results shown in Table A that according to the present invention, the light-sensitive materials which have excellent hue and image fastness and in which a color fog in cyan is depressed can be defined.

EXAMPLE 2

Samples 201 to 207 were prepared in the same manner as the color photographic light-sensitive material described in Example 1 of JP-A-1-158431, except that the cyan couplers (*3) and (*4) contained in the third layer and the fourth layer were changed in the same mole amounts as shown in Table B.

TABLE B

| Sample No. | Coupler |
|---|---|
| 201 (Comp.) | Comparative compound (1) |
| 202 (Comp.) | Comparative compound (2) |
| 203 (Inv.) | Exemplified compound (1) |
| 204 (Inv.) | Exemplified compound (2) |
| 205 (Inv.) | Exemplified compound (6) |
| 206 (Inv.) | Exemplified compound (12) |
| 207 (Inv.) | Exemplified compound (19) |

Comparative compound (1)

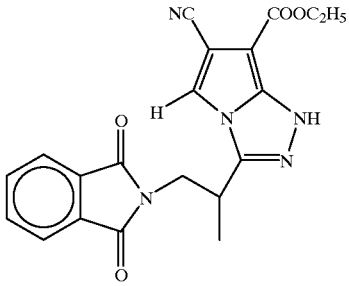

Comparative compound (2)

1 : 1 (mole ratio) mixture of

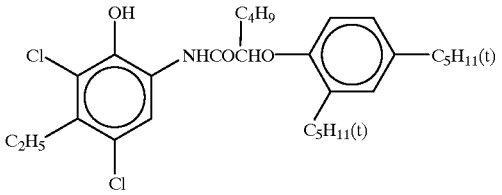

and

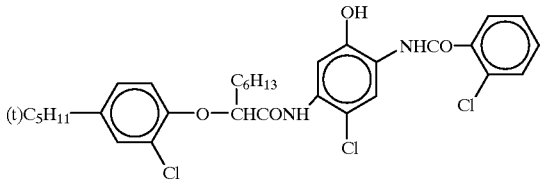

Sample 207 thus prepared was exposed so that about 30% of a coated silver amount was developed to give gray, and then a processing was carried out with an automatic developing machine until the accumulated replenishing amount of a color-developing solution reached three times as much amount as the tank capacity thereof, whereby a running processing solution was prepared. The processing steps and the processing solutions were the same as those in Example 1 of JP-A-1-158431.

Samples 210 to 207 were used to carry out the same evaluations as those in Example 1 for the samples obtained after finishing running to confirm that the samples of the present invention had excellent hue and image fastness and provided a low cyan color fog caused by processing.

EXAMPLE 3

Sample 301 was prepared in the same manner as Sample 101 prepared in Example 1 of JP-A-5-134351, except that the cyan coupler contained in the third layer was replaced with the exemplified coupler (1) of the present invention in the same mole amount.

This sample was subjected to the color-developing processing described in Examples 1 and 2 of JP-A-5-134351.

According to Example 1 in the present invention, a hue, an image fastness and a cyan fog at an unexposed area were evaluated to find that these performances were improved by using the couplers of the present invention.

The present invention can provide the silver halide color photographic light-sensitive material having excellent hue and dye fastness and providing no color fog at an unexposed area.

What is claimed is:

1. A silver halide color light-sensitive material having at least one silver halide light-sensitive emulsion layer on a support, wherein the light sensitive material contains at least one cyan coupler represented by Formula (I) in at least one layer on a support:

(I)

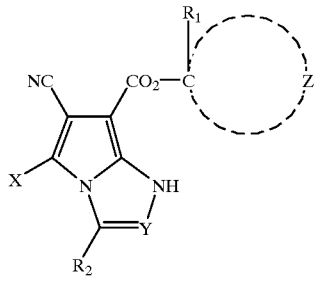

wherein Y represents —N═ or —C($R_3$)═; X represents a hydrogen atom or a group which splits off upon a coupling reaction with an oxidized product of a color developing agent; z represents a non-metallic atomic group necessary for forming an alicyclic group or a heterocyclic ring; and $R_1$, $R_2$ and $R_3$ each represents a hydrogen atom or a substituent selected from the group consisting of a halogen atom, an aliphatic group, an aryl group, a heterocyclic group, an alkoxy group, an aryloxy group, a heterocyclic ring oxy group, an alkyl-, aryl- or heterocyclic ring thio group, an acyloxy group, a carbamoyloxy group, a silyloxy group, an alkyl-, aryl- or heterocyclic ring sulfonyloxy group, an acylamino group, an alkylamino group, an arylamino group, a ureido group, a sulfamoylamino group, an alkenyloxy group, a formyl group, an acyl group, an alkyl-, aryl- or heterocyclic ring-sulfonyl group, an alkyl-, aryl- or heterocyclic ring-sulfinyl group, an alkyl-, aryl- or heterocyclic ring-oxycarbonyl group, an alkyl-, aryl- or heterocyclic ring-oxycarbonylamino group, an alkyl-, aryl- or heterocyclic ring-sulfonamido group, a carbamoyl group, a sulfamoyl group, a phosphonyl group, an imido group, an azolyl group, a hydroxy group, a cyano group, a —COOM group, a —$SO_3$M group (wherein M in —COOM and —$SO_3$M represents a hydrogen atom, an alkali metal atom or $NH_4$), a nitro group and an unsubstituted amino group, said substituents may be further substituted with at least one of said substituents.

2. The silver halide color light-sensitive material as claimed in claim 1, wherein $R_1$ is a hydrogen atom, a halogen atom, an alkyl group, an alkoxy group, an aryl group, an aryloxy group, an alkyl-, aryl- or heterocyclic ring-oxycarbonyl group, or an alkyl-, aryl- or heterocyclic ring-oxycarbonylamino group.

3. The silver halide color light-sensitive material as claimed in claim 1, wherein $R_2$ and $R_3$ each is an alkyl group, an aryl group, a heterocyclic ring group, a carbamoyl group, an acylamino group, or a ureido group.

4. The silver halide color light-sensitive material as claimed in claim 1, wherein Z forms a 3 to 12 membered alicyclic ring or heterocyclic ring which may be further condensed.

5. The silver halide color light-sensitive material as claimed in claim 1, wherein at least one atom in the ring formed with Z has at least one substituent selected from the group consisting of a halogen atom, an aliphatic group, an aryl group, a heterocyclic group, an alkoxy group, an aryloxy group, a heterocyclic ring oxy group, an alkyl-, aryl- or heterocyclic ring thio group, an acyloxy group, a carbamoyloxy group, a silyloxy group, an alkyl-, aryl- or heterocyclic ring sulfonyloxy group, an acylamino group, an alkylamino group, an arylamino group, a ureido group, a sulfamoylamino group, an alkenyloxy group, a formyl group, an acyl group, an alkyl-, aryl- or heterocyclic ring-sulfonyl group, an alkyl-, aryl- or heterocyclic ring-sulfinyl group, an alkyl-, aryl- or heterocyclic ring-oxycarbonyl group, an alkyl-, aryl- or heterocyclic ring-oxycarbonylamino group, an alkyl-, aryl- or heterocyclic ring-sulfonamido group, a carbamoyl group, a sulfamoyl group, a phosphonyl group, an imido group, an azolyl group, a hydroxy group, a cyano group, —COOM and —$SO_3$M (wherein M represents a hydrogen atom, an alkali metal atom or $NH_4$), a nitro group, and an unsubstituted amino group, said substituents may be further substituted with at least one of said substituents.

6. The silver halide color light-sensitive material as claimed in claim 1, wherein Z is an alkylene group.

7. The silver halide color light-sensitive material as claimed in claim 1, wherein said alicyclic group formed by Z is selected from the group consisting of a cyclopropane ring, a cyclobutane ring, a cyclobutene ring, a cyclopentane ring, a cyclopentene ring, a cyclohexane ring, a cyclohexene ring, a cyclohexadiene ring, a cycloheptane ring, a cyclooctane ring, a norbornane ring, and an adamantane ring.

8. The silver halide color light-sensitive material as claimed in claim 1, wherein said heterocyclic ring formed by Z is a saturated or unsaturated heterocyclic ring containing at least one hetero atom selected from the group consisting of a nitrogen atom, a sulfur atom, an oxygen atom, and a phosphorous atom.

9. The silver halide color light-sensitive material as claimed in claim 1, wherein said heterocyclic ring formed by Z is comprised of an alkylene group, an alkenylene group, —NH—, —O—, —S—, —N═, a sulfonyl group, a carbonyl group, or a combination thereof.

10. The silver halide color light-sensitive material as claimed in claim 1, wherein said heterocyclic ring formed by Z is selected from the group consisting of an oxirane ring, an oxolane ring, a 1,3-dioxolane ring, a furan ring, a 1,3-dioxane ring, a 1,4-dioxane ring, a γ-pyran ring, an oxane ring, a thiophene ring, a thiolane ring, a thiane ring, a 1,4-dithiane ring, an azetidine ring, a pyrrole ring, a pyrrolidine ring, a pyrazole ring, a 2-pyrazoline ring, a pyrazolidine ring, an imidazole ring, a 2-imidazoline ring, an imidazolidine ring, a 1,2,3-triazole ring, a 1,2,4-triazole ring, a tetrazole ring, an oxazole ring, a thiazole ring, a pyridine ring, a piperidine ring, a piperazine ring, a 1,3,5-triazine ring, a pyrazolone ring, and a sulfolane ring.

11. The silver halide color light-sensitive material as claimed in claim 1, wherein said cyan coupler is a compound represented by Formula (I-1):

(I-1)

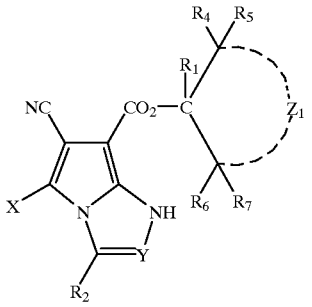

wherein X, Y, $R_1$, and $R_2$ has the same meaning as those defined in Formula (I), respectively; and $R_4$, $R_5$, $R_6$ and $R_7$ each represents a hydrogen atom or a substituent; said substituent represented by $R_4$ to $R_7$ has the same meaning as those represented by $R_3$ in Formula (I).

12. The silver halide color light-sensitive material as claimed in claim 1, wherein said cyan coupler is a compound represented by Formula (I-2):

(I-2)

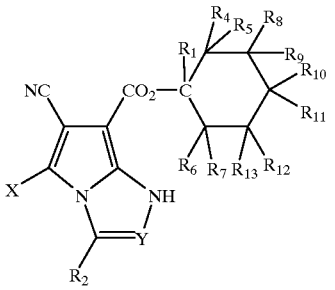

wherein X, Y, $R_1$, and $R_2$ have the same meaning as those defined in Formula (I), respectively; and $R_4$, $R_5$, $R_6$, $R_7$, $R_8$, $R_9$, $R_{10}$, $R_{11}$, $R_{12}$ and $R_{13}$ each represents a hydrogen atom or a substituent; said substituent represented by $R_4$ to $R_{13}$ has the same meaning as those represented by $R_3$ in Formula (I).

13. The silver halide color light-sensitive material as claimed in claim 1, wherein said cyan coupler is incorporated into at least one hydrophilic colloid layer coated on the support.

14. The silver halide color light-sensitive material as claimed in claim 13, wherein said hydrophilic colloid layer is a silver halide light-sensitive emulsion layer.

15. The silver halide color light-sensitive material as claimed in claim 14, wherein said silver halide light-sensitive emulsion layer is a red-sensitive silver halide emulsion layer.

16. The silver halide color light-sensitive material as claimed in claim 14, wherein the amount of said cyan coupler is from $1\times10^{-3}$ to 1 mole per mole of silver halide contained in the same layer.

* * * * *